US010524536B2

(12) United States Patent
Bunnell et al.

(10) Patent No.: US 10,524,536 B2
(45) Date of Patent: Jan. 7, 2020

(54) FOOTWEAR SOLE ASSEMBLY WITH INSERT PLATE AND NONLINEAR BENDING STIFFNESS

(71) Applicant: Nike, Inc., Beaverton, OR (US)

(72) Inventors: Dennis D. Bunnell, Vancouver, WA (US); Bryan N. Farris, North Plains, OR (US); Austin Orand, Portland, OR (US); Alison Sheets-Singer, Portland, OR (US); Aaron B. Weast, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 372 days.

(21) Appl. No.: 15/266,647

(22) Filed: Sep. 15, 2016

(65) Prior Publication Data

US 2017/0079375 A1 Mar. 23, 2017

Related U.S. Application Data

(60) Provisional application No. 62/220,633, filed on Sep. 18, 2015, provisional application No. 62/220,758, (Continued)

(51) Int. Cl.
*A43B 13/14* (2006.01)
*A43B 13/12* (2006.01)
(Continued)

(52) U.S. Cl.
CPC ..... *A43B 13/141* (2013.01); *A43B 13/04* (2013.01); *A43B 13/12* (2013.01); *A43B 13/127* (2013.01);
(Continued)

(58) Field of Classification Search
CPC ..... A43B 5/02; A43B 13/141; A43B 13/14; A43B 13/181; A43B 13/183–186; A43B 13/188
See application file for complete search history.

(56) References Cited

U.S. PATENT DOCUMENTS 634,588 A 10/1899 Roche
2,114,526 A 4/1938 Feder
(Continued)

FOREIGN PATENT DOCUMENTS

CA 1151866 A 8/1983
DE 19955550 A1 * 12/2000 ..... A43B 13/183
(Continued)

OTHER PUBLICATIONS

Tim Newcomb, Patrick Peterson, Under Armour unveil bra-like fit in latest football cleats, http://si.com/edge/2015/02/19/patrick-peterson-under-armour-unveil-bra-fit-football-cleat, Feb. 19, 2015.

*Primary Examiner* — Megan E Lynch
(74) *Attorney, Agent, or Firm* — Quinn IP Law

(57) ABSTRACT

A sole assembly for an article of footwear comprises a sole plate with a foot-facing surface with a recess disposed in the foot-facing surface. An insert plate is disposed in the recess. A length of the insert plate between anterior and posterior ends of the insert plate is less than a length of the recess. The insert plate flexes free of compressive loading by the sole plate when a forefoot portion of the sole assembly is dorsiflexed in a first portion of a flexion range, and operatively engages with the sole plate when the forefoot portion is dorsiflexed in a second portion of the flexion range that includes flex angles greater than in the first portion of the flexion range. The sole assembly is dorsiflexed, for example, when the forefoot portion is flexed in accordance with toes bending toward the top of the foot.

20 Claims, 14 Drawing Sheets

Related U.S. Application Data filed on Sep. 18, 2015, provisional application No. 62/220,638, filed on Sep. 18, 2015, provisional application No. 62/220,678, filed on Sep. 18, 2015.

(51) Int. Cl.

| | |
|---|---|
| ***A43B 13/04*** | (2006.01) |
| ***A43B 13/18*** | (2006.01) |
| ***A43B 17/02*** | (2006.01) |
| ***A43B 13/22*** | (2006.01) |
| ***A43B 23/02*** | (2006.01) |
| ***A43C 15/16*** | (2006.01) |
| *A43B 5/02* | (2006.01) |

(52) U.S. Cl.

CPC ..... *A43B 13/181* (2013.01); *A43B 13/186* (2013.01); *A43B 13/188* (2013.01); *A43B 13/223* (2013.01); *A43B 17/02* (2013.01); *A43B 23/026* (2013.01); *A43B 23/028* (2013.01); *A43C 15/16* (2013.01); *A43B 5/02* (2013.01)

(56) References Cited

U.S. PATENT DOCUMENTS

| | | | | |
|---|---|---|---|---|
| 2,227,426 | A | 1/1941 | Davis, Jr. | |
| 2,379,139 | A | 6/1945 | Flink | |
| 2,413,545 | A | 12/1946 | Cordi | |
| 2,640,283 | A | 6/1953 | McCord | |
| 3,834,046 | A * | 9/1974 | Fowler | A43B 13/181 36/28 |
| 4,667,423 | A * | 5/1987 | Autry | A43B 13/12 36/102 |
| 4,779,361 | A * | 10/1988 | Kinsaul | A43B 13/141 36/102 |
| 4,924,606 | A | 5/1990 | Montgomery et al. | |
| 5,517,769 | A | 5/1996 | Zhao | |
| 5,528,842 | A * | 6/1996 | Ricci | A43B 13/12 36/103 |
| 6,237,255 | B1 | 5/2001 | Renaudin et al. | |
| 7,513,065 | B2 | 4/2009 | Kita et al. | |
| 7,600,332 | B2 | 10/2009 | Lafortune | |
| 8,104,195 | B2 | 1/2012 | Cavasin | |
| 8,365,444 | B2 * | 2/2013 | Youngs | A43B 13/141 36/102 |
| 9,066,559 | B2 | 6/2015 | Butler | |
| 2002/0007571 | A1 * | 1/2002 | Ellis, III | A43B 13/141 36/102 |
| 2003/0140523 | A1 | 7/2003 | Issler | |
| 2003/0208929 | A1 * | 11/2003 | Lucas | A43B 3/0063 36/28 |
| 2004/0221485 | A1 * | 11/2004 | Pfander | A43B 1/0009 36/30 R |
| 2005/0039350 | A1 * | 2/2005 | Hung | A43B 7/32 36/107 |
| 2005/0081401 | A1 | 4/2005 | Singleton et al. | |
| 2006/0123665 | A1 * | 6/2006 | Covatch | A43B 13/141 36/102 |
| 2006/0156579 | A1 * | 7/2006 | Hoffer | A43B 1/0009 36/28 |
| 2007/0039208 | A1 * | 2/2007 | Bove | A43B 3/26 36/97 |
| 2007/0199213 | A1 * | 8/2007 | Campbell | A43B 3/0057 36/102 |
| 2008/0289220 | A1 * | 11/2008 | Rivas | A43B 3/0036 36/88 |
| 2009/0019729 | A1 * | 1/2009 | Nakano | A43B 7/14 36/91 |
| 2009/0100718 | A1 | 4/2009 | Gerber | |
| 2009/0293315 | A1 * | 12/2009 | Auger | A43B 5/02 36/114 |
| 2010/0154258 | A1 * | 6/2010 | Scholz | A43B 13/141 36/30 R |
| 2010/0186257 | A1 * | 7/2010 | Karl | A43B 5/12 36/44 |
| 2010/0313447 | A1 * | 12/2010 | Becker | A43B 13/026 36/102 |
| 2012/0055047 | A1 * | 3/2012 | Youngs | A43B 13/141 36/25 R |
| 2013/0031804 | A1 * | 2/2013 | Abshire | A43B 7/1425 36/103 |
| 2014/0068969 | A1 * | 3/2014 | Blevens | A43B 1/0072 36/92 |
| 2014/0250723 | A1 * | 9/2014 | Kohatsu | A43B 3/26 36/88 |
| 2014/0259744 | A1 * | 9/2014 | Cooper | A43B 3/0057 36/28 |
| 2014/0366401 | A1 * | 12/2014 | Cavaliere | A43B 13/14 36/103 |
| 2015/0089841 | A1 | 4/2015 | Smaldoneet et al. | |
| 2015/0173456 | A1 * | 6/2015 | Rushbrook | A43B 13/141 36/25 R |
| 2015/0201704 | A1 * | 7/2015 | Huber | A43B 3/246 36/25 R |
| 2015/0223564 | A1 * | 8/2015 | Peyton | A43B 13/20 36/29 |
| 2016/0058123 | A1 * | 3/2016 | Peyton | A43B 13/183 36/25 R |
| 2017/0079373 | A1 * | 3/2017 | Huard | A43B 13/026 |
| 2017/0079374 | A1 | 3/2017 | Farris et al. | |
| 2017/0079376 | A1 | 3/2017 | Bunnell et al. | |
| 2017/0079378 | A1 | 3/2017 | Farris et al. | |
| 2018/0199666 | A1 * | 7/2018 | Moriyasu | A43B 13/16 |

FOREIGN PATENT DOCUMENTS

| | | | | |
|---|---|---|---|---|
| DE | 102012104264 | A1 | 11/2013 | |
| EP | 1483981 | A1 | 12/2004 | |
| FR | 892219 | A | 3/1944 | |
| FR | 2974482 | A1 | 11/2012 | |
| WO | WO-2004028285 | A1 * | 4/2004 | A43B 13/141 |
| WO | 2006087737 | A1 | 8/2006 | |
| WO | WO-2008062113 | A1 * | 5/2008 | A43B 3/0036 |
| WO | 2011005728 | A1 | 1/2011 | |
| WO | 2011149581 | A1 | 12/2011 | |

* cited by examiner

FOOTWEAR SOLE ASSEMBLY WITH INSERT PLATE AND NONLINEAR BENDING STIFFNESS

CROSS-REFERENCE TO RELATED APPLICATIONS

This application claims the benefit of priority to U.S. Provisional Application No. 62/220,633 filed Sep. 18, 2015, which is hereby incorporated by reference in its entirety. This application claims the benefit of priority to U.S. Provisional Application No. 62/220,758 filed Sep. 18, 2015, which is hereby incorporated by reference in its entirety. This application claims the benefit of priority to U.S. Provisional Application No. 62/220,638 filed Sep. 18, 2015, which is hereby incorporated by reference in its entirety. This application claims the benefit of priority to U.S. Provisional Application No. 62/220,678 filed Sep. 18, 2015, which is hereby incorporated by reference in its entirety.

TECHNICAL FIELD

The present teachings generally include a sole assembly for an article of footwear.

BACKGROUND

Footwear typically includes a sole assembly configured to be located under a wearer's foot to space the foot away from the ground. Sole assemblies in athletic footwear are configured to provide desired cushioning, motion control, and resiliency.

DESCRIPTION

Figure 1:
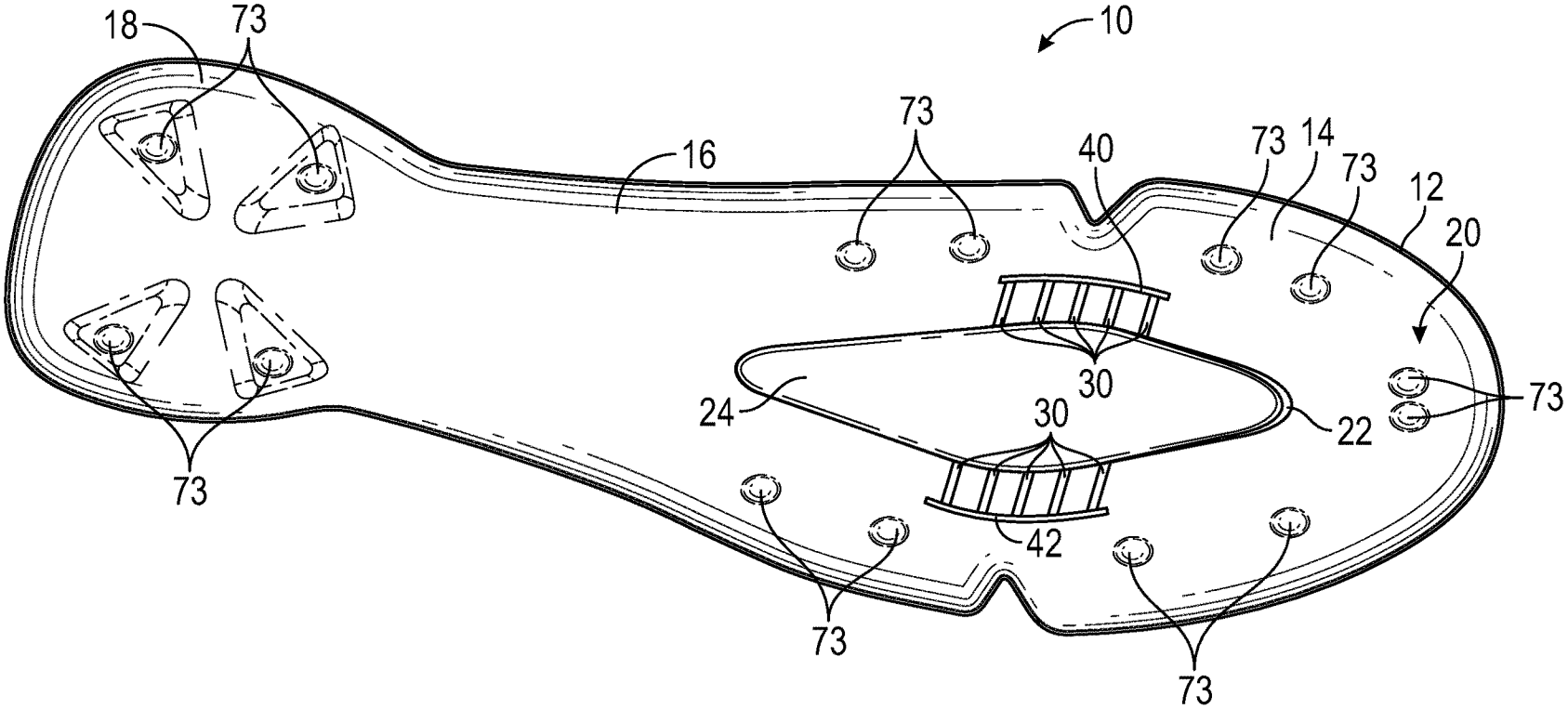
FIG. 1 is a schematic illustration in plan view of a sole assembly for an article of footwear with a sole plate and an insert plate.

A sole assembly for an article of footwear comprises a sole plate that has a foot-facing surface with a recess disposed in the foot-facing surface. An insert plate is disposed in the recess, and has a length extending between anterior and posterior ends of the insert plate. The length between the anterior and posterior ends is less than a length of the recess. The insert plate flexes free of compressive loading by the sole plate when a forefoot portion of the sole assembly is dorsiflexed in a first portion of a flexion range, and operatively engages with the sole plate when the forefoot portion of the sole assembly is dorsiflexed in a second portion of the flexion range that includes flex angles greater than in the first portion of the flexion range. The sole assembly is dorsiflexed, for example, when the forefoot portion is flexed in accordance with toes bending toward the top of the foot.

The first portion of the flexion range includes flex angles of the sole assembly less than a first predetermined flex angle, and the second portion of the flexion range includes flex angles of the sole assembly greater than or equal to the first predetermined flex angle. The anterior and posterior ends of the insert plate operatively engage with the sole plate at the first predetermined flex angle such that the insert plate flexes under compression by the sole plate when the sole assembly dorsiflexed at flex angles greater than or equal to the first predetermined flex angle. Accordingly, the sole assembly has a change in bending stiffness at the first predetermined flex angle.

In an embodiment, the insert plate is unfixed within the recess in that no portion of the insert plate is fixed to prevent motion relative to the sole plate. The insert plate can thus translate relative to the sole plate up to the first predetermined flex angle, and therefore operatively engages with the sole plate only at an outer perimeter of the insert plate.

In an embodiment, the insert plate may have a front edge extending from a medial side of the insert plate to a lateral side of the insert plate and a rear edge extending from the medial side of the insert plate to the lateral side of the insert plate. The sole plate may have a front wall at a forward perimeter of the recess, and a rear wall at a rearward perimeter of the recess. The front edge is configured to operatively engage with the front wall at the entire forward perimeter, and the rear edge is configured to operatively engage with the rear wall at the entire rearward perimeter to distribute compressive loading of the insert plate by the sole plate over the front edge and the rear edge of the insert plate. The front edge and the rear edge may be rounded between the medial side and the lateral side.

The sole plate may have a lip at the recess. The lip may be configured such that the length of the recess below the lip is greater than a length of the recess at the lip. The front wall and rear wall may therefore be slightly under the lip when the insert plate operatively engages with the sole plate so that the lip helps retain the insert plate in the recess during operative engagement.

In an embodiment, at least one groove extends lengthwise transversely in the foot-facing surface of the sole plate. Stated differently, the at least one groove extends along its length at least partially in the transverse direction of the sole plate. The at least one groove is configured to be open when the sole assembly is dorsiflexed at flex angles less than a predetermined second flex angle, and closed when the sole assembly is dorsiflexed at flex angles greater than or equal to the second predetermined flex angle. The sole plate has a resistance to deformation in response to compressive forces across the at least one groove when the at least one groove is closed so that the sole assembly has an additional change in bending stiffness at the second predetermined flex angle.

The at least one groove has at least a predetermined depth and width. In an embodiment, the length of the insert plate and the depth and width of the at least one groove are such that the insert plate operatively engages with the sole plate prior to the at least one groove closing, the second predetermined flex angle thereby being greater than the first predetermined flex angle. In another embodiment, the length of the insert plate and the depth and width of the at least one groove are such that the at least one groove closes prior to the insert plate operatively engaging with the sole plate, the second predetermined flex angle thereby being less than the first predetermined flex angle. In still another embodiment, the length of the insert plate and the depth and width of the at least one groove are such that the insert plate operatively engages with the sole plate when the at least one groove closes, the second predetermined flex angle thereby being the same as the first predetermined flex angle.

The predetermined depth and width of the at least one groove may be selected so that adjacent walls of the sole plate at the at least one groove are nonparallel when the at least one groove is open. For example, a forward one of the adjacent walls at the at least one groove may incline forward more than a rearward one of the adjacent walls at the at least one groove when the at least one groove is open.

The at least one groove may extend transversely beyond the recess. The at least one groove may be straight. The at least one groove has a medial end and a lateral end, and the lateral end may be rearward of the medial end. The at least one groove may be narrower at a base than at a distal end when the at least one groove is open.

The sole plate may have a greater bending stiffness than the insert plate both when the at least one groove is open and when the at least one groove is closed. Alternatively, the insert plate may have a greater bending stiffness than the sole plate both when the at least one groove is open and when the at least one groove is closed, or the insert plate may have a greater bending stiffness than the sole plate only when the at least one groove is open.

Optionally, the sole plate may be chamfered or rounded at the at least one groove. The sole plate may have a base portion below the at least one groove. The sole plate may be under increased tension at the base portion and under compression at the closed grooves when the at least one groove closes.

In an embodiment, a portion of the sole plate at the at least one groove may protrude downward at a ground-facing surface and may be thicker than immediately fore and aft portions of the sole plate. Traction elements may protrude further downward at the ground-facing surface than the portion of the sole plate at the at least one groove.

In an embodiment, the sole plate may include a first slot extending longitudinally relative to the sole plate and through the sole plate between a medial side of the sole plate and the at least one groove, and a second slot extending longitudinally relative to the sole plate and through the sole plate between a lateral side of the sole plate and the at least one groove. Stated differently, the first slot and the second slot extend lengthwise at least partially in the longitudinal direction of the sole plate. The at least one groove extends from the first slot to the second slot.

Additionally, the sole plate may include a first notch in a medial side of the sole plate and a second notch in a lateral side of the sole plate, with the first and second notches aligned with the at least one groove.

In an embodiment, the insert plate is configured to translate in the recess relative to the sole plate when the sole assembly is flexed in a longitudinal direction of the sole assembly over a first range of flexion, such that the insert plate is free from compressive loading by the sole plate during the first range of flexion. The insert plate is configured to operatively engage with the sole plate in the recess when the sole plate is flexed in the longitudinal direction at the first predetermined flex angle thereby placing the insert plate under compression by the sole plate in a second range of flexion greater than the first range of flexion. The sole assembly thereby having a change in bending stiffness at the first predetermined flex angle.

In such an embodiment, the sole plate may have at least one groove in the foot-facing surface. The at least one groove may be open during the first range of flexion, and closed when the sole assembly is flexed in the longitudinal direction over a third range of flexion greater than the second range of flexion. Alternatively, the third range of flexion may be greater than the first range of flexion and less than the second range of flexion. The sole assembly has a different bending stiffness in the third range of flexion than in the second range of flexion. For example, with the at least one groove closed, compressive forces are applied at the at least one closed groove so that the sole plate is in compression at a distal portion of the closed grooves.

A resilient material, such as but not limited to a polymeric foam, may be disposed in the recess between the sole plate and at least one the anterior end and the posterior end of the insert plate. The resilient material may be compressed prior to operative engagement of the insert plate with the sole plate when the sole assembly is flexed in the longitudinal direction. Bending stiffness of the sole assembly is thus at least partially determined by a stiffness of the resilient material at flex angles less than the first predetermined flex angle.

A resilient material, such as but not limited to a polymeric foam, may be disposed in the at least one groove such that the resilient material is compressed by closing of the at least one groove. Bending stiffness of the sole assembly is thus at least partially determined by a stiffness of the resilient material at flex angles less than the second predetermined flex angle.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

Referring to the drawings, wherein like reference numbers refer to like components throughout the views, FIG. 1 shows a sole assembly 10 for an article of footwear. The sole assembly 10 has a nonlinear bending stiffness that increases with increasing flexing of the forefoot portion 14 in the longitudinal direction. As further explained herein, the sole assembly 10 provides a change in bending stiffness when flexed in a longitudinal direction at one or more predetermined flex angles. More particularly, the sole assembly 10 has a bending stiffness that is a piecewise function with changes at the one or more predetermined flex angles. The bending stiffness is tuned by the selection of various structural parameters discussed herein that determine the one or more predetermined flex angles. As used herein, "bending stiffness" and "bend stiffness" may be used interchangeably.

The sole assembly 10 has a full-length, unitary sole plate 12 that has a forefoot portion 14, a midfoot portion 16, and a heel portion 18. The sole plate 12 provides a foot-facing surface 20 that extends over the forefoot portion 14, the midfoot portion 16, and the heel portion 18.

The heel portion 18 generally includes portions of the sole plate 12 corresponding with rear portions of a human foot, including the calcaneus bone, when the human foot is supported on the sole assembly 10 and is a size corresponding with the sole assembly 10. The forefoot portion 14 generally includes portions of the sole plate 12 corresponding with the toes and the joints connecting the metatarsals with the phalanges of the human foot (interchangeably referred to herein as the "metatarsal-phalangeal joints" or "MPJ" joints). The midfoot portion 16 generally includes portions of the sole plate 12 corresponding with an arch area of the human foot, including the navicular joint. As used herein, a lateral side of a component for an article of footwear, including a lateral side 38 (also referred to as a lateral edge 38) of the sole plate 12, is a side that corresponds with an outside area of the human foot (i.e., the side closer to the fifth toe of the wearer). The fifth toe is commonly referred to as the little toe. A medial side of a component for an article of footwear, including a medial side 36 (also referred to as a medial edge 36) of the sole plate 12, is the side that corresponds with an inside area of the human foot (i.e., the side closer to the hallux of the foot of the wearer). The hallux is commonly referred to as the big toe. Both the lateral side 38 and the medial side 36 extend from a foremost extent to a rearmost extent of a periphery of the sole plate 12. These descriptions of the relative positions of a heel portion, a midfoot portion, a forefoot portion, a medial side, and a lateral side of the sole plate 12 may also be used to describe portions of the article of footwear in which the sole plate 12 is included, including the sole structure, and individual components thereof.

The sole plate 12 is referred to as a plate, but is not necessarily flat and need not be a single component but instead can be multiple interconnected components. For example, both an upward-facing portion of the foot-facing surface 20 and the opposite ground-facing surface 64 may be pre-formed with some amount of curvature and variations in thickness when molded or otherwise formed in order to provide a shaped footbed and/or increased thickness for reinforcement in desired areas. For example, the sole plate 12 could have a curved or contoured geometry that may be similar to the lower contours of the foot 52 of FIG. 7.

The sole plate 12 may be entirely of a single, uniform material, or may have different portions comprising different materials. For example, a first material of the forefoot portion 14 can be selected to achieve the desired bending stiffness in the forefoot portion 14, while a second material of the midfoot portion 16 and the heel portion 18 can be a different material that has little effect on the bending stiffness of the forefoot portion 14. By way of non-limiting example, the second portion can be over-molded on or co-injection molded with the first portion. Example materials for the sole plate 12 include durable, wear resistant materials such as but not limited to nylon, thermoplastic polyurethane, or carbon fiber.

The term "longitudinal," as used herein, refers to a direction extending along a length of the sole assembly, e.g., from a forefoot portion to a heel portion of the sole assembly. The term "transverse," as used herein, refers to a direction extending along a width of the sole assembly, e.g., from a lateral side to a medial side of the sole assembly. The term "forward" is used to refer to the general direction from the heel portion toward the forefoot portion, and the term "rearward" is used to refer to the opposite direction, i.e., the direction from the forefoot portion toward the heel portion. The term "anterior" is used to refer to a front or forward component or portion of a component. The term "posterior" is used to refer to a rear or rearward component of portion of a component. The term "plate" refers to a generally horizontally-disposed member generally used to provide structure and form rather than cushioning. A plate can be but is not necessarily flat and need not be a single component but instead can be multiple interconnected components. For example, a sole plate may be pre-formed with some amount of curvature and variations in thickness when molded or otherwise formed in order to provide a shaped footbed and/or increased thickness for reinforcement in desired areas. For example, the sole plate could have a curved or contoured geometry that may be similar to the lower contours of the foot 52.

Figure 7:
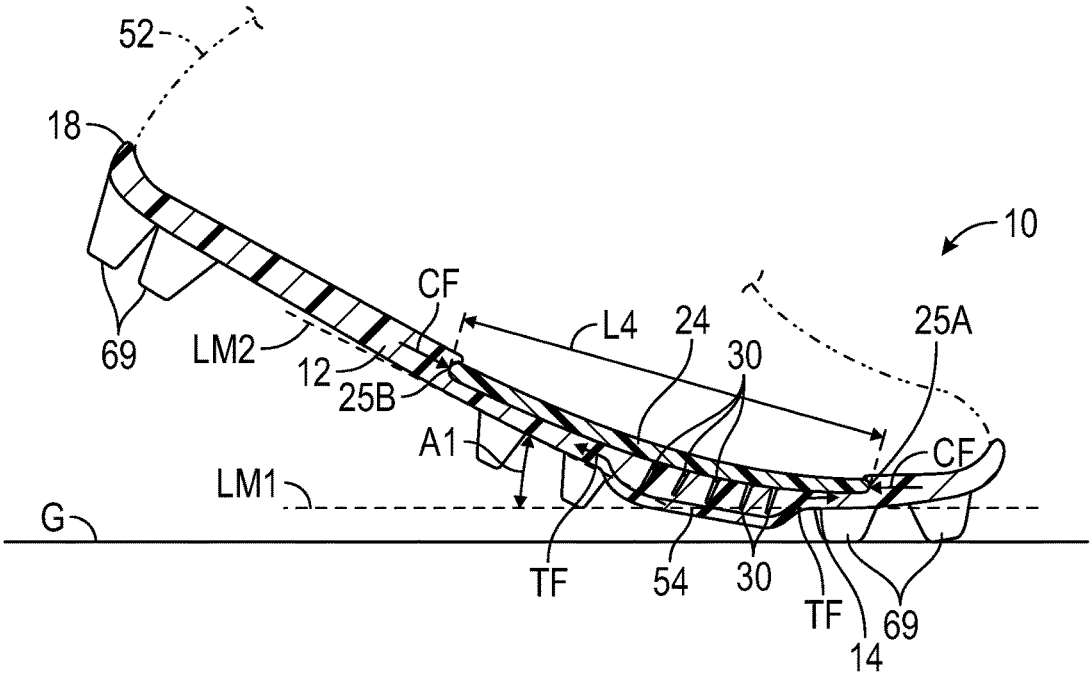
FIG. 7 is a schematic cross-sectional illustration in fragmentary side view of the sole assembly of FIG. 6 flexed at a first predetermined flex angle.

As shown in FIG. 7, a foot 52 can be supported by the foot-facing surface 20, with the foot above the foot-facing surface 20. The foot-facing surface 20 may be referred to as an upper surface of the sole plate 12. In the embodiment shown, the sole plate 12 is an outsole. In other embodiments, the sole plate may be an insole plate, also referred to as an insole, an inner board plate, inner board, insole board, or lasting board. Still further, the sole plate could be a midsole plate or a unisole plate, or may be one of, or a unitary combination of any two or more of, an outsole, a midsole, and/or an insole (also referred to as an inner board plate). Optionally, in the embodiment shown, an insole plate, or other layers may overlay the foot-facing surface 20 and be positioned between the foot 52 and the foot-facing surface 20.

Figure 2:
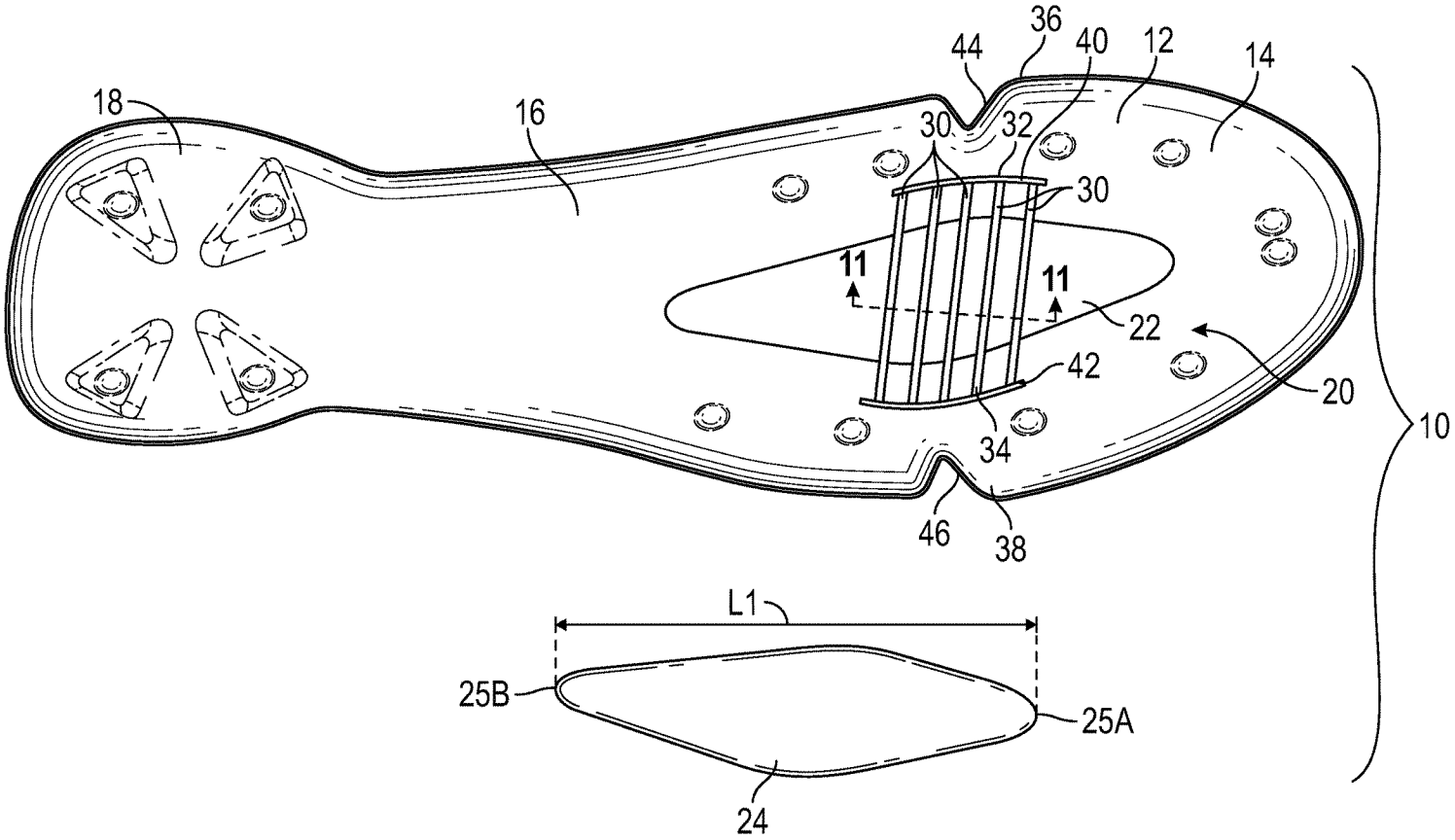
FIG. 2 is a schematic illustration in exploded plan view of the sole assembly of FIG. 1.
Figure 4:
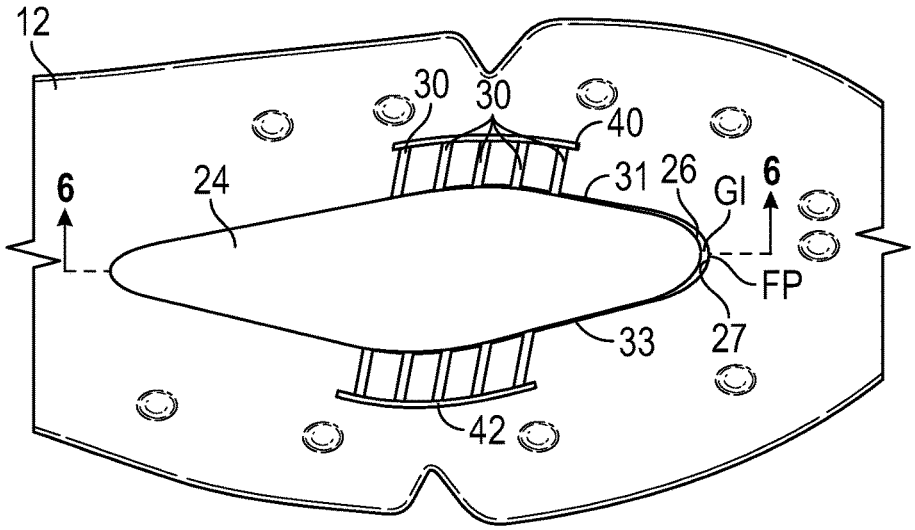
FIG. 4 is a schematic illustration in fragmentary plan view of the sole assembly with the insert plate in a rearward position.
Figure 5:
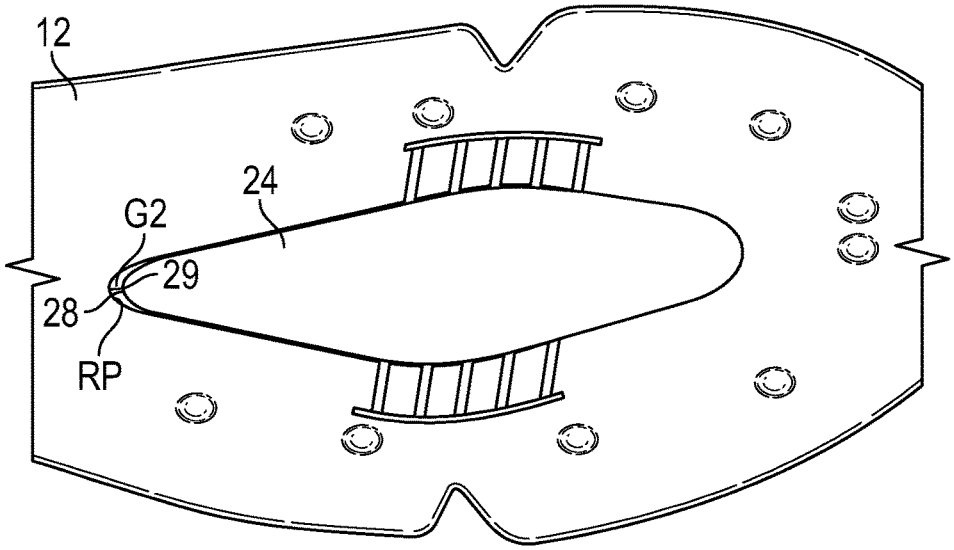
FIG. 5 is a schematic illustration in fragmentary plan view of the sole assembly with the insert plate translated to a forward position.

A recess 22 is provided in the foot-facing surface 20 at the forefoot portion 14. The recess 22 is relatively shallow such that it does not extend completely through the sole plate 12. An insert plate 24 is disposed lengthwise in the recess 22. Referring to FIG. 2, the insert plate 24 has a length L1 extending between an anterior end 25A and a posterior end 25B of the plate 24 in a generally longitudinal direction of the sole plate 12. The length L1 is slightly less than a length L2 of the recess 22. As best shown in FIGS. 4 and 5, this difference in length allows the insert plate 24 to translate fore and aft in the recess 22 relative to the sole plate 12 when the sole assembly 10 is in an unflexed state or is flexed in the forefoot region 14 at relatively low flex angles (i.e., when the flex angle is less than a first predetermined flex angle A1 shown in FIG. 9). The insert plate 24 may be referred to as a floating plate as it has the ability to translate relative to the sole plate 12 over this range of flex angles. The insert plate 24 is unfixed within the recess 22. Stated differently, there are no pins, posts, or other components holding any portion of the insert plate 24 fixed relative to the sole plate 12.

The predetermined flex angle is defined as the angle formed at the intersection between a first axis LM1 and a second axis LM2 where the first axis generally extends along a longitudinal midline LM at a ground-facing surface 64 of sole plate 12 (best shown in FIG. 3) anterior to the anterior end 25A of the insert plate 24 and also anterior to the descending portion of the sole plate including the optional grooves 30 and the base portion 54, and the second axis LM2 generally extends along a longitudinal axis, such as the longitudinal midline LM at the ground-facing surface 64 of the sole plate 12 posterior to the posterior end 25B of the insert plate 24 and also posterior to the descending portion of the sole plate including the grooves 30 and the base portion 54. The sole plate 12 is configured so that the intersection of the first and second axes LM1 and LM2 will typically be approximately centered both longitudinally and transversely below the insert plate 24 and the grooves 30 discussed herein, and below the metatarsal-phalangeal joints of the foot 52 supported on the foot-facing surface 20. By way of non-limiting example, the first predetermined flex angle A1 may be from about 30 degrees (°) to about 65°. In one exemplary embodiment, the first predetermined flex angle A1 is found in the range of between about 30° and about 60°, with a typical value of about 55°. In another exemplary embodiment, the first predetermined flex angle A1 is found in the range of between about 15° and about 30°, with a typical value of about 25°. In another example, the first predetermined flex angle A1 is found in the range of between about 20° and about 40°, with a typical value of about 30°. In particular, the first predetermined flex angle can be any one of 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, 60°, 61°, 62°, 63°, 64°, or 65°. Generally, the specific flex angle or range of angles at which a change in the rate of increase in bending stiffness occurs is dependent upon the specific activity for which the article of footwear is designed.

Figure 9:
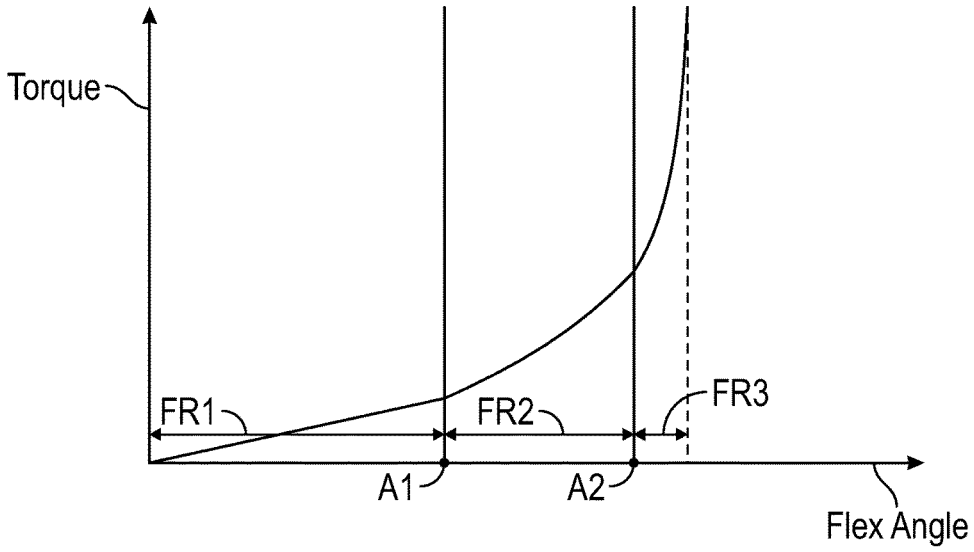
FIG. 9 is a plot of torque versus flex angle for the sole assembly of FIGS. 1-8.

Due to the difference in length of the insert plate 24 and the recess 22, at flex angles less than the first predetermined flex angle A1 of FIGS. 7 and 9, a gap exists between one or both ends of the insert plate 24 and the sole plate 12. More specifically, a gap G1 exists between a rounded forward edge 26 of the insert plate 24 and a rounded front wall 27 of the sole plate 12 at a forward perimeter FP of the recess 22 when the insert plate 24 is in a rear position in the recess 22, as shown in FIG. 4. The rear position is the rearmost position of the insert plate 24 in the recess 22. The rounded forward edge 26 extends from a medial side 31 to a lateral side 33 of the insert plate 24. Similarly, at flex angles less than the first predetermined flex angle A1, a gap G2 exists between a rounded rearward edge 28 of the insert plate 24 and a rounded rear wall 29 of the sole plate 12 at a rearward perimeter RP of the recess 22 when the insert plate 24 is in a front position, as show in FIG. 5. The front position is the forward most position of the insert plate 24 in the recess 22. The rounded rearward edge 28 extends from the medial side 31 to the lateral side 33 of the insert plate 24. The rear position and the front position of the insert plate 24 shown in FIGS. 4 and 5 are the extreme positions of the insert plate 24 within the recess 22. During normal use at flex angles less than the first predetermined flex angle A1, the insert plate 24 could be at either the front position, the rear position, or at an intermediate position with gaps at both ends. The difference in length, and the gap (e.g., gap G1 or gap G2) created by the difference, enable the insert plate 24 to flex free of compressive loading by the sole plate 12 when the sole assembly 10 is flexed in a longitudinal direction of the sole assembly 10 at flex angles less than the first predetermined flex angle A1.

In some embodiments, there may be more than one recess 22 each with a respective insert plate 24 therein. For example, two or more recesses can be positioned laterally adjacent one another (i.e., side-by-side). A first insert plate is positioned in the first recess, and a second insert plate is positioned in the second recess. The recesses and insert plates may be configured so that the insert plates operatively engage with the sole plate at the same flex angle. Alternatively, the insert plates and recesses can be configured to engage at different flex angles, such as by having different sized gaps when in an unflexed position. The insert plates would thus engage in a sequential series to affect change the bending stiffness at each flex angle where one of the insert plates engages.

Figure 6:
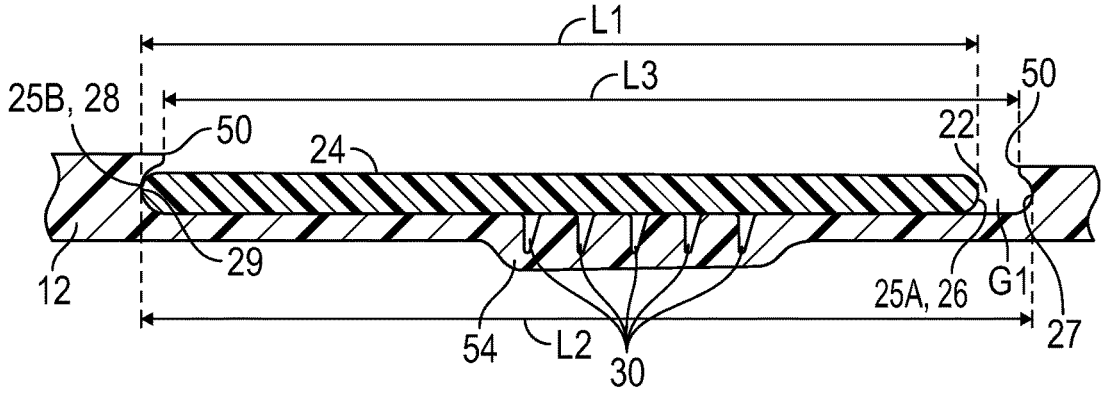
FIG. 6 is a schematic cross-sectional illustration in fragmentary side view of the sole assembly taken at lines 6-6 in FIG. 4.
Figure 8:
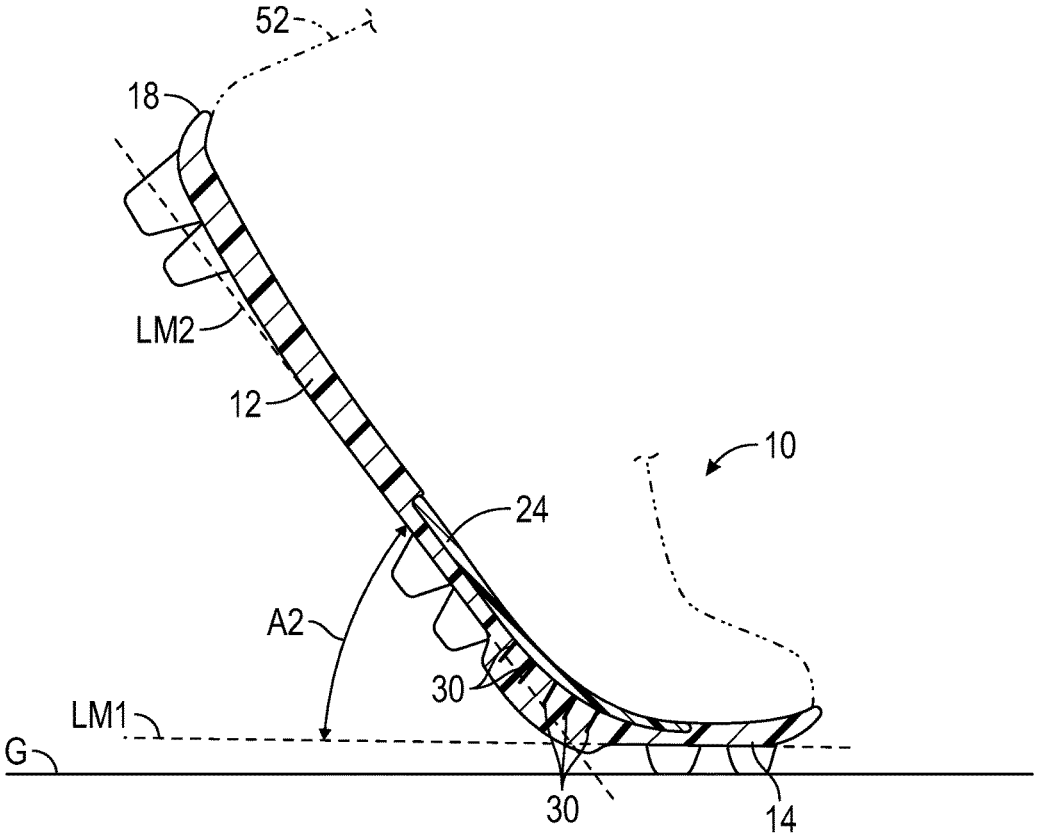
FIG. 8 is a schematic cross-sectional illustration in fragmentary side view of the sole assembly of FIG. 6 flexed at a second predetermined flex angle.

FIGS. 6-8 illustrate operation of the insert plate 24. FIG. 6 shows the insert plate 24 in the rear position in the recess 22. The sole plate 12 has a lip 50 surrounding the recess 22 and configured such that the length L2 of the recess 22 below the lip 50 is greater than a length L3 of the recess 22 at the lip 50. The lip 50 thus creates an undercut of the sole plate 12 surrounding the insert plate 24. The insert plate 24 can be inserted into the recess 22 by pressing the insert plate 24 past the lip 50. The length L1 of the insert plate 24 and the length L2 of the recess 22 are selected so that both the forward edge 26 and the rearward edge 28 of the insert plate 24 and the anterior and posterior ends 25A, 25B thereof cannot be in contact with the front and rear walls 27, 29, respectively, at the same time during flexing of the sole assembly 10 in the longitudinal direction at flex angles less than the first predetermined flex angle A1. Accordingly, as a foot 52 (shown in phantom in FIG. 7) flexes placing torque on the sole assembly 10 and causing the sole assembly 10 to flex at the forefoot portion 14 by lifting the heel portion 18 away from the ground G while maintaining contact with the ground G at a forward portion of the forefoot portion 14, the insert plate 24 will flex, but will do so free from compressive loading by the sole plate 12 over a first range of flexion FR1 (i.e., flex angles of less than the predetermined first flex angle A1, shown in FIG. 9). The bending stiffness of the sole assembly 10 during the first range of flexion FR1 will be at least partially correlated with the bending stiffness of the sole plate 12 and of the insert plate 24, but there is no compressive loading of the insert plate 24 by the sole plate 12.

Referring to FIG. 7, when the sole assembly 10 is flexed in the longitudinal direction at flex angles greater than or equal to the first predetermined flex angle A1, the anterior and posterior ends 25A, 25B of the insert plate 24 operatively engage with the sole plate 12 such that the insert plate 24 flexes under compression by the sole plate 12 (indicated by force arrows CF in FIG. 7). The insert plate 24 operatively engages with the sole plate 12 at the first predetermined flex angle only at an outer perimeter of the sole plate 12, which includes the anterior end 25A, the posterior end 25B, the forward edge 26, and the rearward edge 28. The grooves 30 in the sole plate 12 are moving toward a closed state but remain open at the first predetermined flex angle A1, as shown in FIG. 7. As used herein, the insert plate 24 is "operatively engaged" with the sole plate 12 when compressive force of the sole plate 12 is transferred to the insert plate 24 during flexing in the longitudinal direction. Due to the operative engagement of the insert plate 24 and the sole plate 12, a base portion 54 of the sole plate 12 below the recess 22 and closer to the ground G (and therefore further from the center of curvature of the flexing) is under additional tension. The tension is indicated by force arrows TF in FIG. 7. The sole assembly 10 thereby has a change in bending stiffness at the first predetermined flex angle A1. As will be understood by those skilled in the art, during bending of the sole plate 12 as the foot 52 is flexed, there is a neutral axis of the sole plate 12 above which the sole plate 12 is in compression, and below which the sole plate 12 is in tension. The operative engagement of the insert plate 24 with the sole plate 12 places additional tension on the sole plate 12 below the neutral axis, such as at a bottom surface of the sole plate 12, effectively shifting the neutral axis of the sole plate 12 upward (away from the bottom surface).

The stiffness of the sole assembly 10 at flex angles greater than or equal to the first predetermined flex angle A1, such as during a second range of flexion FR2 and a third range of flexion FR3 of FIG. 9, is at least partially correlated with the compressive loading of the insert plate 24 and with the added tensile forces on the sole plate 12. More specifically, when the sole assembly 10 is flexed to at least the first predetermined flex angle A1, because the flexing of the sole plate 12 occurs generally in the forefoot portion 14 at the recess 22, the length of the recess 22 between a forward perimeter FP of the recess 22 at the front wall 27 and a rearward perimeter RP of the recess 22 at the rear wall 29 is shorter than the length L2. In other words, the length of the recess 22 in the longitudinal direction is slightly foreshortened, as indicated by length L4 in FIG. 7. The recess 22 is foreshortened more than the insert plate 24 as it is further from the center of curvature of the flexed sole assembly 10. The anterior end 25A and the rounded forward edge 26 of the insert plate 24 thus engages the front wall 27 and the posterior end 25B and the rearward edge 28 of the insert plate 24 engages the rear wall 29 due to the slightly foreshortened recess 22.

In the embodiment shown, the forward edge 26 and the front wall 27 have similar rounded shapes, and the rearward edge 28 and the rear wall 29 have similar rounded shapes. This enables the forward edge 26 to engage the entire forward perimeter FP (i.e., the perimeter of the recess 22 forward of a series of grooves 30 discussed herein), and the rearward edge 28 engages the entire rearward perimeter RP (i.e., the perimeter of the recess rearward of the grooves 30). Compressive forces CF of the sole plate 12 on the insert plate 24 are well distributed over the insert plate 24 along the rounded forward edge 26 and the rounded rearward edge 28 by the generally similarly shaped rounded front wall 27 and rounded rear wall 29, respectively. Stress concentrations that could occur with a narrower interface between the insert plate 24 and the sole plate 12 are avoided. In other embodiments, the forward edge 26, the front wall 27, and/or the rearward edge 28 and the rear wall 29 could instead have a flat, squared-off shape or have other shapes. Still further, the insert plate 24 could be shaped so that only portions of a differently-shaped forward edge and/or a differently-shaped rearward edge contact the front wall and the rear wall, respectively.

Figure 10:
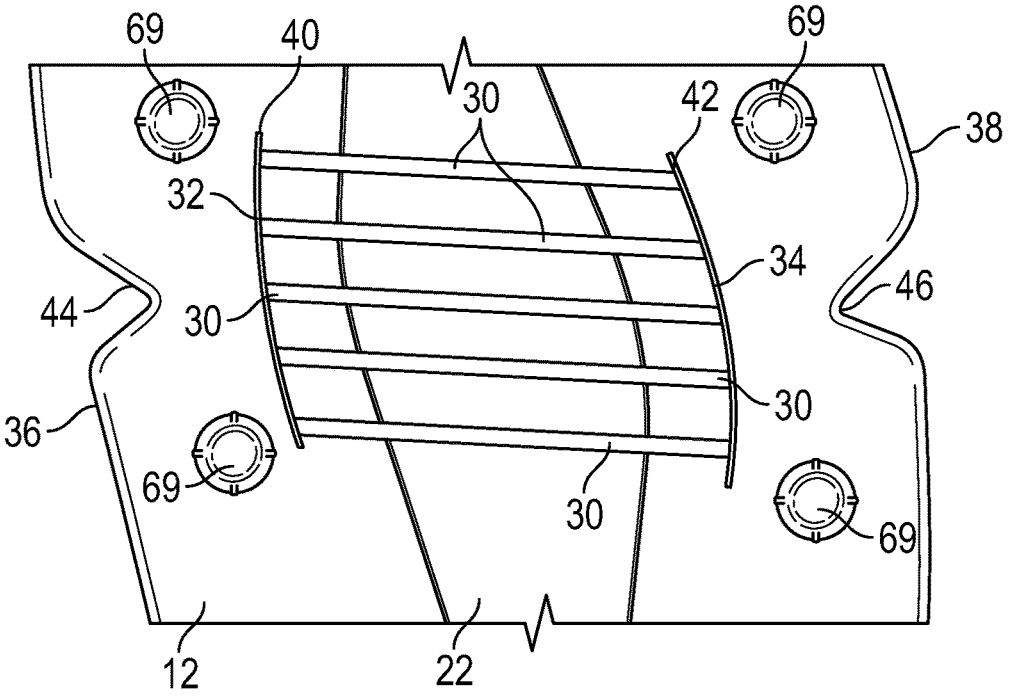
FIG. 10 is a schematic illustration in fragmentary plan view of the sole assembly with the insert plate removed.

Referring to FIGS. 2 and 10, the sole plate 12 has at least one groove 30, and in the embodiment shown has a series of grooves 30, which also affect the bending stiffness of the sole assembly 10. More specifically, the grooves 30 are configured to be open at flex angles less than a second predetermined flex angle and closed at flex angles greater than or equal to the second predetermined flex angle. With the grooves closed, compressive forces on the sole plate 12 are applied across the closed grooves 30. The sole plate 12 at the closed grooves 30 has a resistance to deformation thus increasing the bending stiffness of the sole assembly 10 when the grooves 30 close. The grooves 30 are optional, and the scope of the present teachings also includes a sole plate 12 without grooves in the foot-facing surface 20, as the operative engagement of the insert plate 24 with such a sole plate 12 would also provide a nonlinear bending stiffness.

The grooves 30 extend lengthwise generally transversely relative to the sole plate at the recess 22. Each groove 30 is generally straight, and the grooves 30 are generally parallel to one another. The grooves 30 may be formed, for example, during molding of the sole plate 12. Each groove 30 has a medial end 32 and a lateral end 34 (indicated with reference numbers on one of the grooves 30 in FIG. 2), with the medial end 32 closer to a medial side 36 of the sole plate 12, and the lateral end 34 closer to a lateral side 38 of the sole plate 12. The lateral end 34 is slightly rearward of the medial end 32 so that the grooves 30 fall under and generally follow the anatomy of the metatarsal phalangeal joints of the foot 52. The grooves 30 extend lengthwise generally transversely in the sole plate 12 beyond the recess 22 toward both the medial side 36 and the lateral side 38. As shown in FIG. 1, when the insert plate 24 is inserted in the recess 22, middle portions of the grooves 30 are covered by the insert plate 24, while end portions of the grooves 30 extend beyond the recess 22 and insert plate 24.

The number of grooves 30 can be only one (i.e., a single groove), or there may be multiple grooves 30. Generally, the width and depth of the grooves 30 will depend upon the number of grooves 30 and will be selected so that the one or more grooves close at the second predetermined flex angle described herein. In various embodiments having more than one groove 30, the grooves could have different depths, widths, and or spacing from one another, and could have different angles (i.e., adjacent walls of different grooves could be at different relative angles). For example, grooves toward the middle of the series of grooves in the longitudinal direction could be wider than grooves toward the anterior and posterior ends of the series of grooves. Generally, the overall width of the one or more grooves (i.e., from the anterior end to the posterior end of the series of grooves) is selected to be sufficient to accommodate a range of positions of a wearer's metatarsal phalangeal joints based on population averages for the particular size of footwear. If only one groove is provided, it will generally have a greater width than if multiple grooves 30 are provided in order to close at the same predetermined flex angle.

Figure 11:
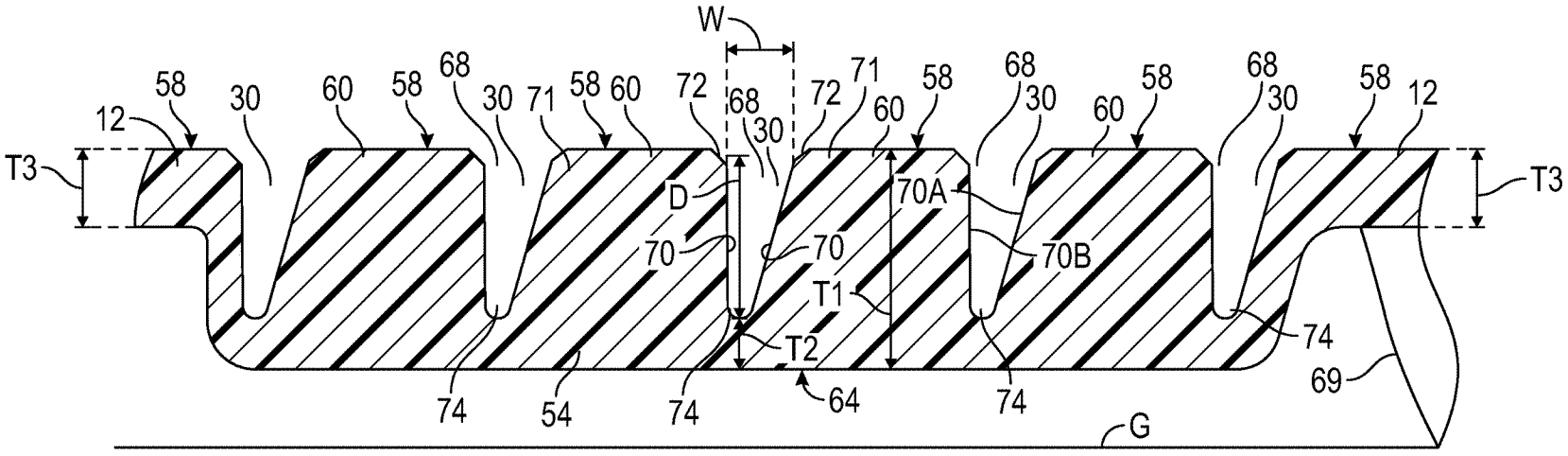
FIG. 11 is a schematic cross-sectional illustration in fragmentary view of the sole plate of FIG. 2 taken at lines 11-11 in FIG. 2 with the grooves open.
Figure 12:
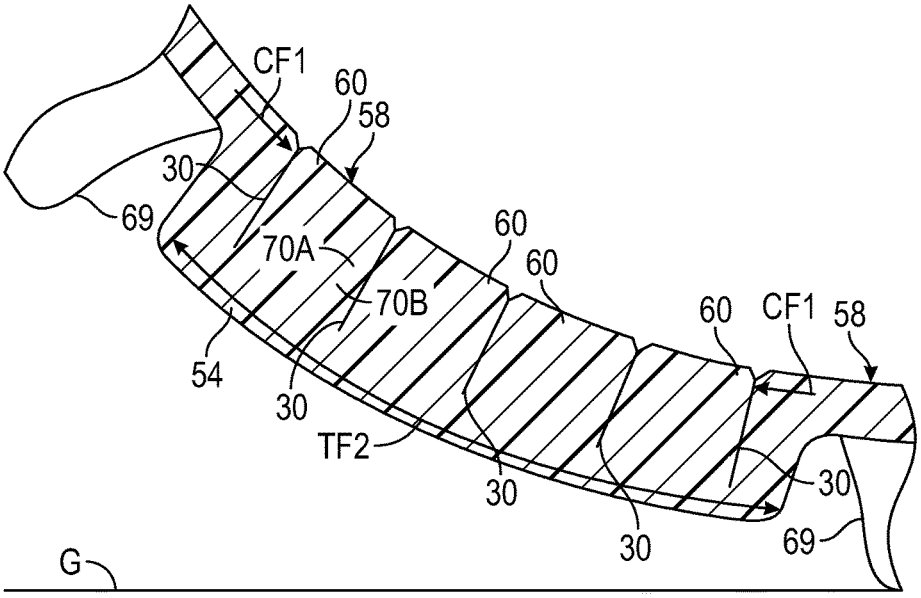
FIG. 12 is a schematic cross-sectional illustration in fragmentary view of the sole plate of FIG. 8 with the grooves closed.

As best shown in FIG. 2, the sole plate 12 includes a first slot 40 that extends lengthwise generally longitudinally relative to the sole plate 12 and completely through the sole plate 12 between the medial side 36 and the series of grooves 30. The sole plate 12 also has a second slot 42 that extends lengthwise generally longitudinally relative to the sole plate 12 and completely through the sole plate 12 between the lateral side 38 and the series of grooves 30. The first and second slots 40, 42 are curved, bowing toward the medial and lateral side 36, 38, respectively. The grooves 30 extend from the first slot 40 to the second slot 42. In other words, the medial end 32 of each groove 30 is at the first slot 40, and the lateral end 34 of each groove 30 is at the second slot 42. In other embodiments, two or more sets of series of grooves can be spaced transversely apart from one another (e.g., with one set on a medial side of the longitudinal midline LM, extending from the first slot 40 and terminating before the longitudinal midline LM, and the other set on a lateral side of the longitudinal midline LM, extending from the second slot 42 and terminating before the longitudinal midline LM). Similarly, three or more sets can be positioned transversely and spaced apart from one another. Unlike the slots 40, 42, the grooves 30 do not extend completely through the sole plate 12, as indicated in FIGS. 11 and 12. The slots 40, 42 help to isolate the series of grooves 30 from the portions of the sole plate 12 outward of the grooves 30 (i.e., the portion between the first slot 40 and the medial side 36 and the portion between the second slot 42 and the lateral side 38) during flexing of the sole plate 12.

The sole plate 12 includes a first notch 44 in the medial side 36 of the sole plate 12, and a second notch 46 in a lateral side 38 of the sole plate. As best shown in FIG. 10, the first and second notches 44, 46 are generally aligned with the series of grooves 30 but are not necessarily parallel with the grooves 30. In other words, a line connecting the notches 44, 46 would pass through the series of grooves 30. The notches 44, 46 increase flexibility of the sole plate 12 in the area of the forefoot portion 14 where the grooves 30 are located. The material of the sole plate 12 outward of the slots 40, 42 thus has little effect on the flexibility of the forefoot portion 14 of the sole plate 12 in the longitudinal direction.

Figure 3:
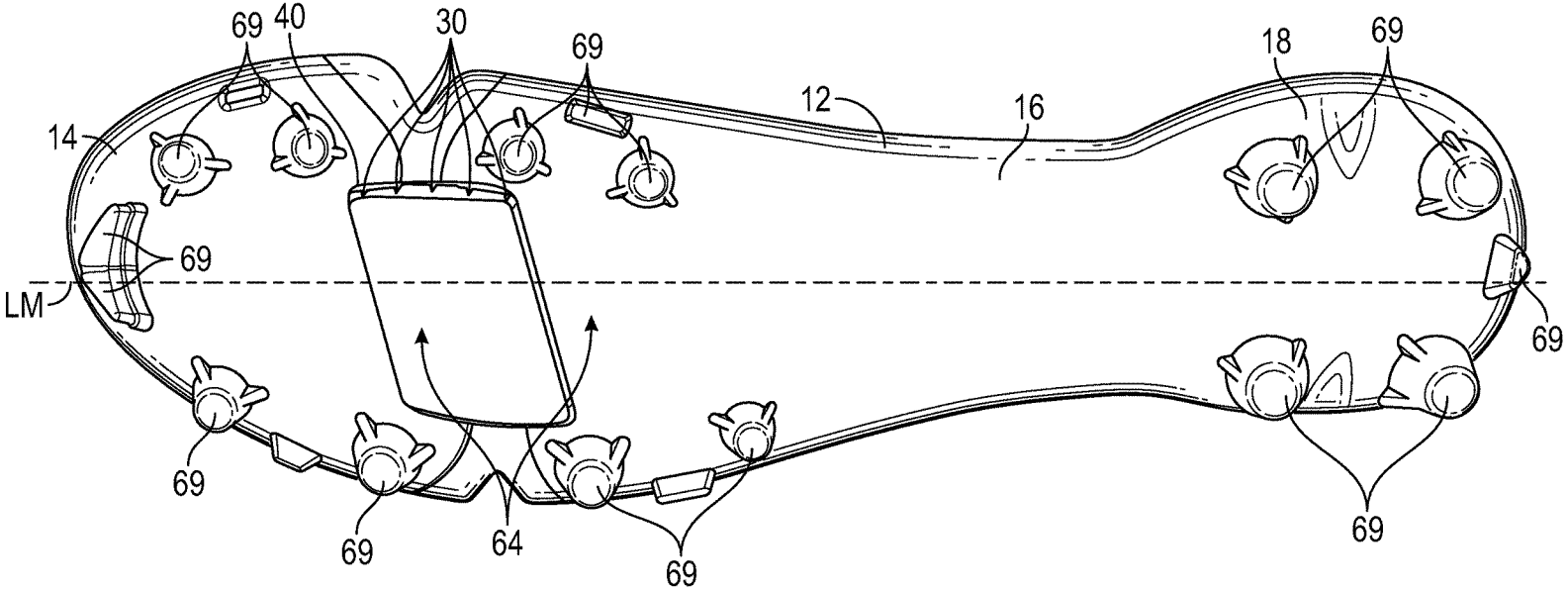
FIG. 3 is a schematic illustration in perspective view showing a bottom of the sole plate of FIG. 1.

Referring to FIG. 11, the grooves 30 in the sole plate 12 create transversely-extending ribs 60 adjacent each groove 30. Each groove 30 has a predetermined depth D from the surface 58 of the sole plate 12 at the recess 22 to a base portion 54 of the sole plate 12 below the groove 30. In other embodiments, different ones of the grooves 30 may have different depths, each at least the predetermined depth D. The depth D is less than the thickness T1 of the sole plate 12 from the surface 58 to a ground-facing surface 64 of the sole plate 12. The difference between the thickness T1 and the depth D is the thickness T2 of the base portion 54. As best shown in FIGS. 3 and 11, the sole plate 12 protrudes downward at the ground-facing surface 64 below the grooves 30 and ribs 60, enabling the thickness T1 of the sole plate 12 at the series of grooves 30 to be greater than a thickness T3 of portions of the sole plate 12 immediately fore and aft of the grooves 30. Correspondingly, the depth D is greater than if the grooves 30 were in a portion of the sole plate 12 having only the thickness T3.

The sole plate 12 has traction elements 69 that protrude further from the ground-facing surface 64 than the portion of the sole plate 12 at the series of grooves 30, thus ensuring that the ground-facing surface 64 of the portion of the sole plate 12 at the series of grooves 30 is either removed from ground-contact (i.e., lifted above the ground G) or at least bears less load. Ground reaction forces on the base portion 54 that could lessen flexibility of the base portion 54 and affect opening and closing of the grooves 30 are thus reduced. The traction elements 69 may be integrally formed as part of the sole plate 12 or may be attached to the sole plate 12. In the embodiment shown, the traction elements 69 are integrally formed cleats. For example, as best shown in FIGS. 1 and 3, the sole plate 12 has dimples 73 on the foot-facing surface 20 where the traction elements 69 extend downward. In other embodiments, the traction elements may be, for example, removable spikes.

Referring to FIG. 11, each groove 30 has a predetermined width W at a distal end 68 of the groove 30, remote from the base portion 54. Distal ends 71 of the ribs 60 may be rounded or chamfered at each groove 30, as indicated in FIG. 11 by chamfer 72. When the grooves 30 close, the chamfered or rounded distal ends 71 reduce the possibility of plastic deformation of the ribs 60 as could occur with sharp corner contact when compressive forces are applied across the closed grooves 30 at adjacent ribs 60. The width W is measured between adjacent side walls 70 of adjacent ribs 60 at the start of any chamfer (i.e., at the point on the side wall 70 just below any chamfered or rounded edge). Each of the grooves 30 is narrower at a base 74 of the groove 30 (i.e., at a root of the groove 30 just above the base portion 54) than at the distal end 68 (i.e., at the widest portion of the groove 30 closest to the foot-facing surface 20 and the foot 52) when the grooves 30 are open. Although each groove 30 is depicted as having the same width W, different ones of the grooves 30 could have different widths.

Optionally, the predetermined depth D and predetermined width W can be tuned (i.e., selected) so that adjacent side walls 70 (i.e. a front side wall 70A and a rear side wall 70B at each groove 30) are nonparallel when the grooves 30 are open, as shown in FIG. 11. The adjacent side walls 70A, 70B are parallel when the grooves 30 are closed, as shown in FIG. 12. By configuring the sole plate 12 so that the side walls 70A, 70B are nonparallel in the open position, surface area contact of the side walls 70 is maximized when the grooves 30 are closed. In such an embodiment, the entire planar portions of the side walls 70 below the chamfers 72 and above the base 74 can simultaneously come into contact when the grooves 30 close. In contrast, if the adjacent side walls 70A, 70B were parallel when the grooves 30 were open, then the side walls 70 would be non-parallel at least when the grooves 30 initially close, potentially resulting in a reduced contact area of the adjacent walls and/or stress concentrations.

Optionally, the grooves 30 can be configured so that forward side walls 70A at each of the grooves 30 incline forward more than rearward walls 70B at each of the grooves 30 when the grooves 30 are open and the sole plate 12 is in an unflexed position as shown in FIGS. 6 and 11. The unflexed position is the position of the sole plate 12 when the heel portion 18 is not lifted and traction elements 69 at both the forefoot portion 14 and the heel portion 18 are in contact with the ground G. The relative inclinations of the side walls 70A, 70B affects when the grooves 30 close. Inclining the forward side walls 70A more than the rearward side walls 70B ensures that the grooves 30 close at a greater second predetermined flex angle A2 than if the rearward side wall 70B inclined forward more than the forward side wall 70A.

FIG. 11 shows the grooves 30 in an open position. The grooves 30 are configured to be open when the sole assembly 10 is flexed in the longitudinal direction at flex angles less than a second predetermined flex angle A2 shown in FIG. 9. Stated differently, the grooves 30 are configured to be open during the first range of flexion FR1 (in which the insert plate 24 is not operatively engaged with the sole plate 12), and during the second range of flexion FR2 (in which the insert plate 24 is operatively engaged with the sole plate 12). The grooves 30 are configured to close when the sole assembly 10 is flexed in the longitudinal direction at flex angles greater than or equal to the second predetermined flex angle A2 (i.e., in a third range of flexion FR3). When the grooves 30 close, the sole plate 12 has a resistance to deformation in response to compressive forces across the closed grooves 30 so that the sole assembly 10 has an additional change in bending stiffness at the second predetermined flex angle A2. FIG. 12 shows the side walls 70 in contact, and the resulting compressive forces CF1 at the distal ends 71 of the ribs 60 near at least the distal ends 68 of the closed grooves 30, and increased tensile forces TF2 at the base portion 54. The closed grooves 30 provide resistance to the compressive forces CF1, which may elastically deform the ribs 60.

In the embodiment of FIGS. 6-8, the insert plate 24 operatively engages with the sole plate 12 before the grooves 30 close. FIG. 6 shows the insert plate 24 not operatively engaged with the sole plate 12 and the grooves 30 open at an unflexed state of the sole plate 12 (i.e. at a flex angle of 0 degrees). FIG. 7 shows operative engagement of the insert plate 24 with the sole plate 12 at the first predetermined flex angle A1 with the grooves 30 still remaining open. FIG. 8 shows the grooves 30 closed at the second predetermined flex angle A2. Accordingly, the second predetermined flex angle A2 is greater than the first predetermined flex angle A1 in the embodiment of FIGS. 1-8.

FIG. 9 shows an example plot indicating the bending stiffness (slope of the plot) for the sole assembly 10, with torque (in Newton-meters) on the vertical axis and flex angle (in degrees) on the horizontal axis. As is understood by those skilled in the art, the torque results from a force applied at a distance from a bending axis located in the proximity of the metatarsal phalangeal joints, as occurs when a wearer flexes the sole assembly 10. The bending stiffness changes (increases) at the first predetermined flex angle A1 and changes again (increases) at the second predetermined flex angle A2. The bending stiffness is a piecewise function. In the first range of flexion FR1, the bending stiffness is a function of the bending stiffness of the insert plate 24 and the bending stiffness of the sole plate 12 as each bends. In the second range of flexion FR2, the bending stiffness is also a function of the compressive loading of the insert plate 24 by the sole plate 12, and the corresponding increased tensile forces acting on the sole plate 12. In the third range of flexion FR3, the bending stiffness is also a function of the compressive loading of the sole plate 12 across a distal portion of the closed grooves (i.e., a portion closest to the foot-facing surface 20 and the foot 52).

As an ordinarily skilled artisan will recognize in view of the present disclosure, a sole plate 12 will bend in dorsiflexion in response to forces applied by corresponding bending of a user's foot at the MPJ during physical activity. Throughout the first portion of the flexion range FR1, the bending stiffness (defined as the change in moment as a function of the change in flex angle) will remain approximately the same as bending progresses through increasing angles of flexion. Because bending within the first portion of the flexion range FR1 is primarily governed by inherent material properties of the materials of the sole plate 12, a graph of torque (or moment) on the plate versus angle of flexion (the slope of which is the bending stiffness) in the first portion of the flexion range FR1 will typically demonstrate a smoothly but relatively gradually inclining curve (referred to herein as a "linear" region with constant bending stiffness). At the boundary between the first and second portions of the range of flexion, however, the insert plate 24 operatively engages the sole plate 12, such that additional material and mechanical properties exert a notable increase in resistance to further dorsiflexion. Therefore, a corresponding graph of torque versus angle of flexion (the slope of which is the bending stiffness) that also includes the second portion of the flexion range FR2 would show—beginning at an angle of flexion approximately corresponding to angle A1—a departure from the gradually and smoothly inclining curve characteristic of the first portion of the flexion range FR1. This departure is referred to herein as a "nonlinear" increase in bending stiffness, and would manifest as either or both of a stepwise increase in bending stiffness and/or a change in the rate of increase in the bending stiffness. The change in rate can be either abrupt, or it can manifest over a short range of increase in the bend angle (i.e., also referred to as the flex angle or angle of flexion) of the sole plate 12. In either case, a mathematical function describing a bending stiffness in the second portion of the flexion range FR2 will differ from a mathematical function describing bending stiffness in the first portion of the flexion range. The closing of the grooves 30 approximately at the second predetermined flex angle A2 causes another nonlinear increase in bend stiffness manifests as either or both of a stepwise increase in bending stiffness and/or a change in the rate of increase in the bending stiffness.

FIG. 9 is an example plot depicting an expected increase in resistance to flexion at increasing flex angles, as exhibited by the increasing magnitude of torque required at the heel portion 18 for dorsiflexion of the forefoot portion 14. The bending stiffness in the first range of flexion FR1 may be constant (thus the plot would have a linear slope) or substantially linear or may increase gradually (which would show a change in slope in FR1). The bending stiffness in the second range of flexion FR2 may be linear or nonlinear, but will depart from the bending stiffness of the first range of flexion FR1 at the first predetermined flex angle A1, either markedly or gradually (such as over a range of several degrees) at the first predetermined flex angle A1 due to the operative engagement of the insert plate 24.

As will be understood by those skilled in the art, during bending of the sole plate 12 as the foot 52 is dorsiflexed, there is a layer in the sole plate 12 referred to as a neutral plane (although not necessarily planar) or neutral axis above which the sole plate 12 is in compression, and below which the sole plate 12 is in tension. The operative engagement of the insert plate 24 places additional compressive forces on the sole plate 12 above the neutral plane, and additional tensile forces below the neutral plane, nearer the ground-facing surface. In addition to the mechanical (e.g., tensile, compression, etc.) properties of the sole plate 12, structural factors that likewise affect changes in bending stiffness during dorsiflexion include but are not limited to the thicknesses, the longitudinal lengths, and the medial-lateral widths of different portions of the sole plate 12.

Figure 13:
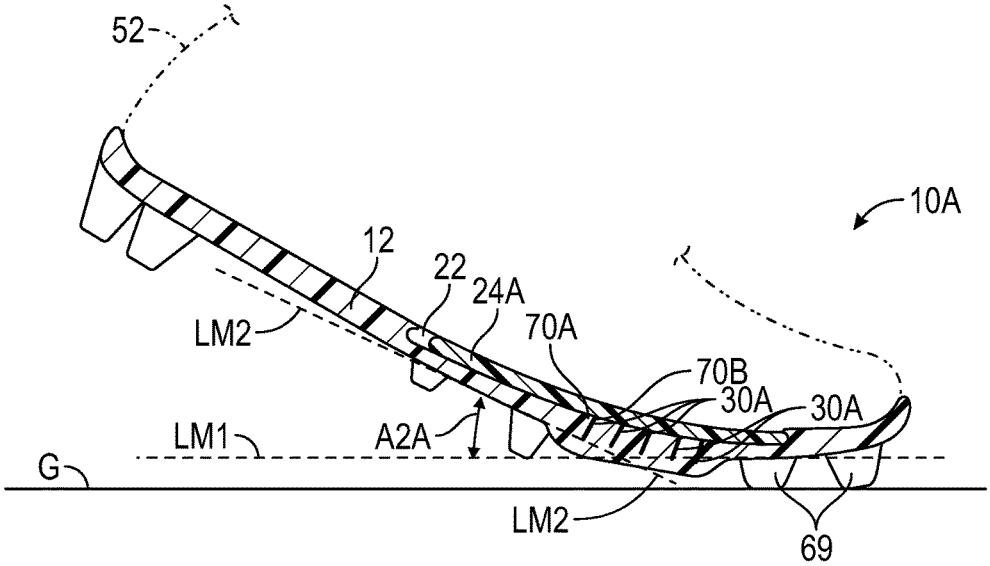
FIG. 13 is a schematic cross-sectional illustration in fragmentary side view of another embodiment of a sole assembly flexed at an alternative second predetermined flex angle in accordance with the present teachings.
Figure 14:
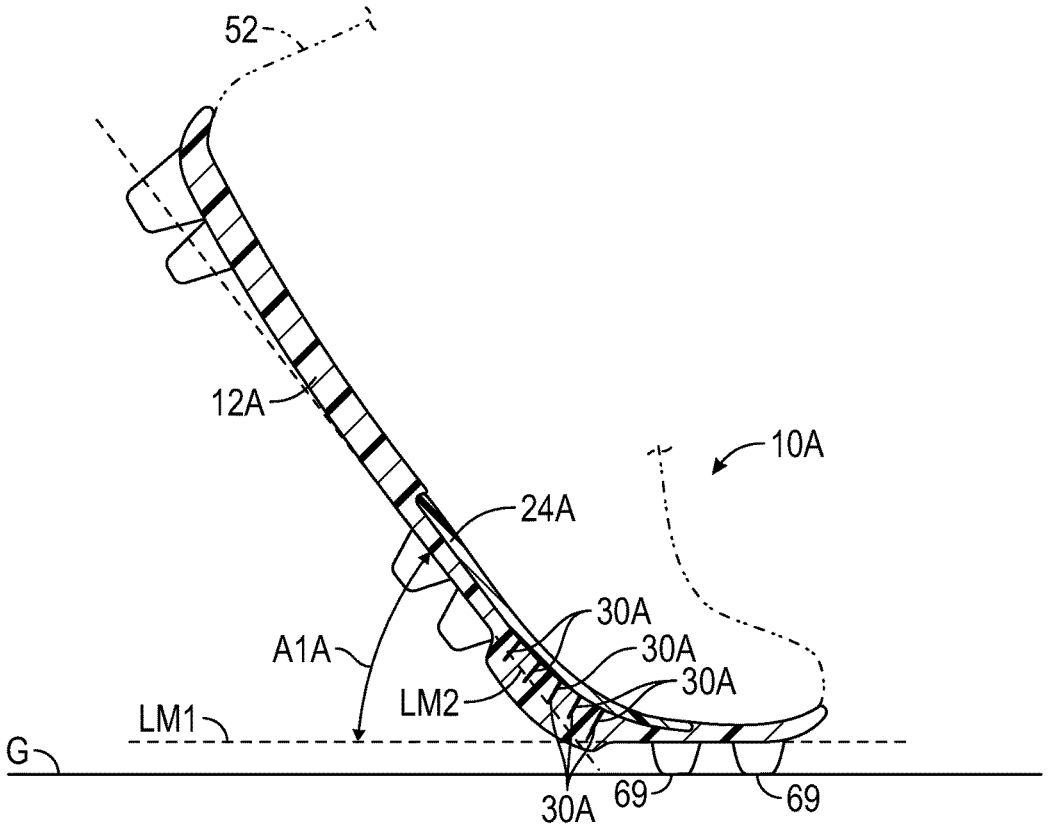
FIG. 14 is a schematic cross-sectional illustration in fragmentary side view of the sole assembly of FIG. 13 flexed at an alternative first predetermined flex angle, in accordance with the present teachings.

FIGS. 13 and 14 show an alternative embodiment of a sole assembly 10A. The sole assembly 10A is alike in all aspects to sole assembly 10, and has identical components as sole assembly 10, except that a sole plate 12A is provided in which the grooves 30 are replaced by groove 30A, and the insert plate 24 is replaced by insert plate 24A. The depth and width of the grooves 30A and the length of the insert plate 24A are selected so that the grooves 30A close prior to the insert plate 24A engaging with the sole plate 12A as the sole assembly 10A is flexed in the longitudinal direction with a different resulting bending stiffness. More specifically, the grooves 30A are configured to close at a flex angle A2A shown in FIG. 15, referred to as the second predetermined flex angle. The grooves 30A have a smaller depth and/or a smaller width than grooves 30 so that the flex angle A2A is less than the second predetermined flex angle A2 of FIG. 8. Additionally, the insert plate 24A has a shorter length than length L1 of insert plate 24, the recess 22 has a shorter length than length L2 of FIG. 6, or both. The insert plate 24A is thus not operatively engaged with the sole plate 12A until a flex angle A1A is reached, which is greater than the first predetermined flex angle A1 of FIG. 9. The flex angle A1A may be referred to as the first predetermined flex angle and is greater than the flex angle A2A. Accordingly, the grooves 30A close prior to the insert plate 24A operatively engaging with the sole plate 12A, the second predetermined flex angle A2A thereby being less than the first predetermined flex angle A1A.

Figure 15:
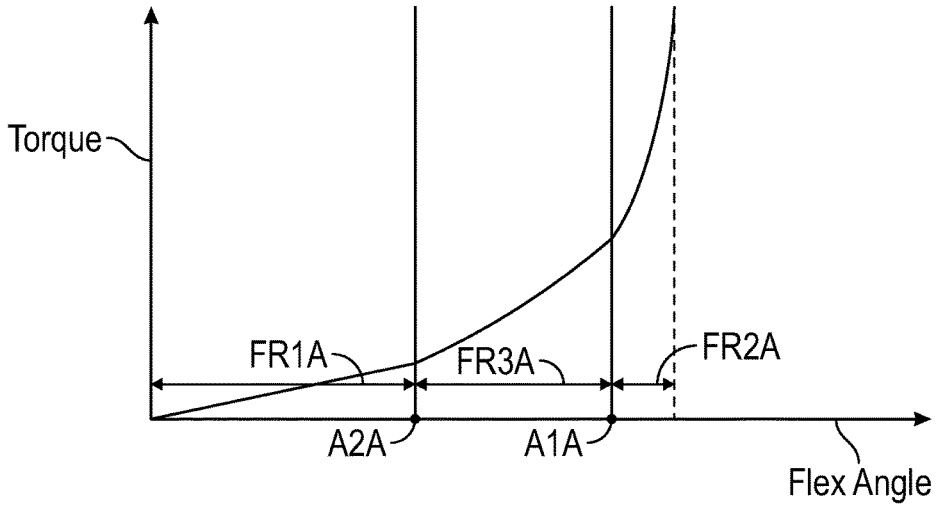
FIG. 15 is a plot of torque versus flex angle for the sole assembly of FIGS. 13-14.

FIG. 15 shows an example plot indicating the bending stiffness (slope of the plot) for the sole assembly 10A, with torque (in Newton-meters) on the vertical axis and flex angle (in degrees) on the horizontal axis. The bending stiffness of the sole assembly 10A changes (increases) at the second flex angle A2A and changes again (increases) at the first flex angle A1A. The bending stiffness is a piecewise function. In the first range of flexion FR1A, the bending stiffness is a function of the bending stiffness of the insert plate 24A and of the sole plate 12A. In a range of flexion FR3A following the first range of flexion FR1A, the bending stiffness is also a function of the compressive loading that occurs across the closed grooves 30A of the sole plate 12A. In a range of flexion FR2A following the range of flexion FR3A, the bending stiffness is also a function of the compressive loading of the insert plate 24A by the sole plate 12 and the corresponding increased tensile forces acting on the sole plate 12A. The range of flexion FR3A is referred to as a third range of flex, and the range of flexion FR2A is referred to as a second range of flexion. Accordingly, side walls 70 of the sole plate 12A at the grooves 30A engage to close the grooves 30A when the sole assembly is flexed in the longitudinal direction over a third range of flexion FR3A greater than the first range of flexion FR1A and less than the second range of flexion FR2A. Closing of the grooves 30A places additional compressive loading on the sole plate 12A at a distal portion of the closed grooves 30A (i.e., at a portion of the closed grooves 30A closest to the foot-facing surface 20 and the foot 52) and increases tensile forces at a base portion 54 of the sole plate 12A, bending stiffness of the sole assembly 12A thereby increasing in the third range of flexion FR3A at least partially in correlation with such loading.

Figure 16:
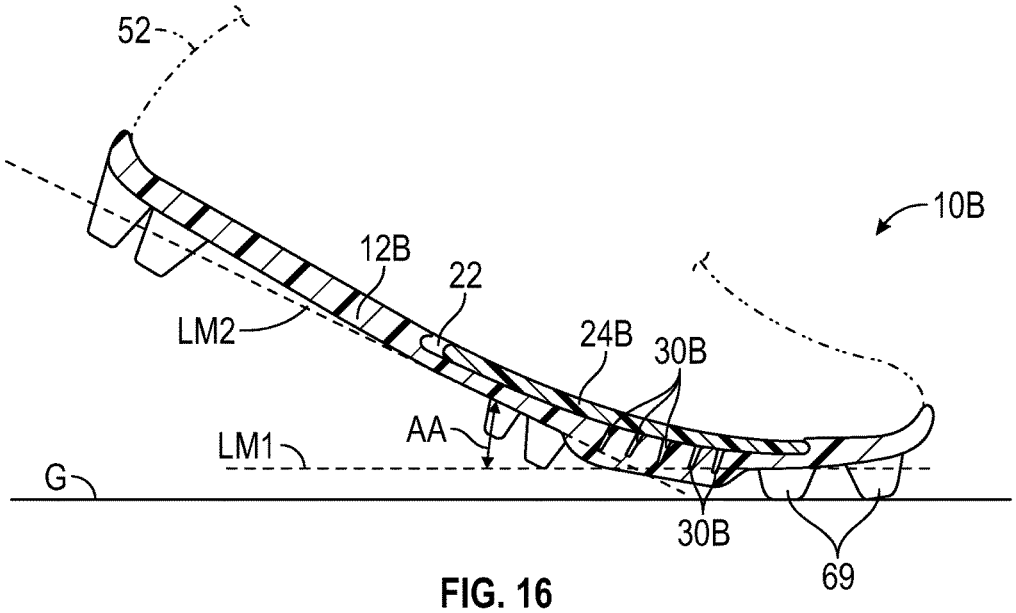
FIG. 16 is a schematic cross-sectional illustration in fragmentary side view of another embodiment of a sole assembly in a flexed position in accordance with the present teachings.
Figure 17:
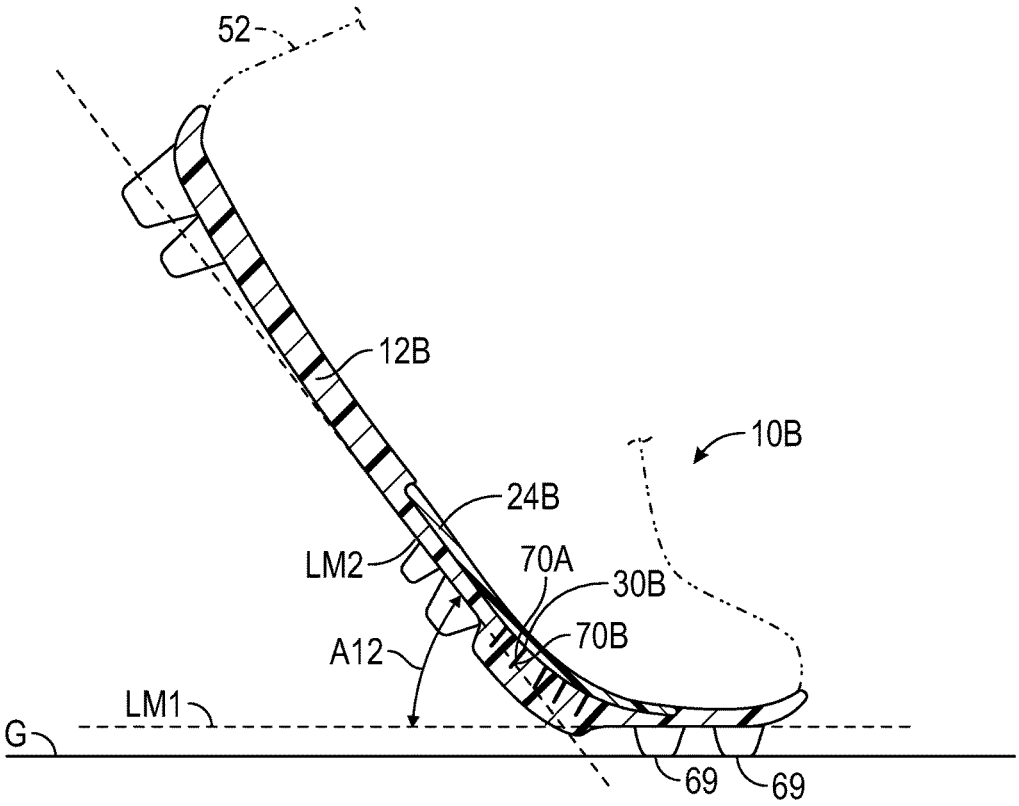
FIG. 17 is a schematic cross-sectional illustration in fragmentary side view of the sole assembly of FIG. 16 flexed at an alternative predetermined flex angle.

FIGS. 16 and 17 show an alternative embodiment of a sole assembly 10B. The sole assembly 10B is alike in all aspects to sole assembly 10, and has identical components as sole assembly 10, except that a sole plate 12B is provided in which the grooves 30 are replaced by grooves 30B, and the insert plate 24 is replaced by insert plate 24B. The depth and width of the grooves 30B and the length of the insert plate 24B are selected so that the grooves 30B close at the same flex angle that the insert plate 24A engages with the sole plate 12B. More specifically, at a flex angle AA shown in FIG. 16, the grooves 30B are open and the insert plate 24B is not operatively engaged with the sole plate 12B. However, at a greater flex angle A12 shown in FIG. 17, the insert plate 24B operatively engages with the sole plate 12B and the grooves 30B close. The flex angle A12 serves as both the first predetermined flex angle (i.e., the flex angle at which the insert plate 24B operatively engages with the sole plate 12B) and as the second predetermined flex angle (i.e., the flex angle at which the grooves 30B close).

Figure 18:
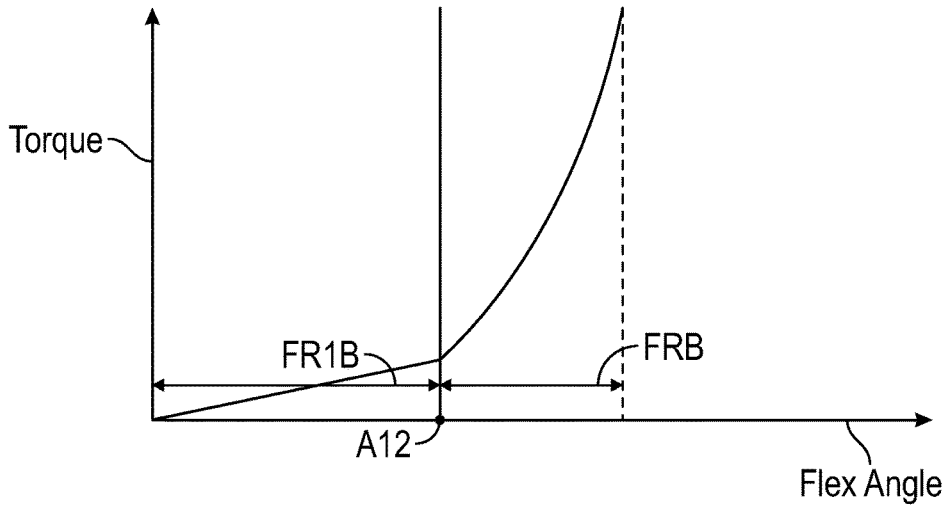
FIG. 18 is a plot of torque versus flex angle for the sole assembly of FIGS. 16-17.

FIG. 18 shows an example plot indicating the bending stiffness (slope of the plot) for the sole assembly 10B, with torque (in Newton-meters) on the vertical axis and flex angle (in degrees) on the horizontal axis, showing a bending stiffness that changes (increases) at the flex angle A12. The bending stiffness is a piecewise function. In the first range of flexion FR1B, the bending stiffness is a function of the bending stiffness of the insert plate 24B and of the sole plate 12B. In a range of flexion FRB following the first range of flexion FR1A, the bending stiffness is also a function of the compressive loading of the insert plate 24B by the sole plate 12B, the compressive loading across the closed groove 30B, and corresponding increased tensile forces on the sole plate 12B. Accordingly, side walls 70 of the sole plate 12B at the grooves 30B engage to close the grooves 30B and the insert plate 24B engages with the sole plate 12B when the sole plate 12B is flexed in the longitudinal direction over a range of flexion FRB greater than the first range of flexion FR1B, thereby placing additional compressive loading at a distal portion of the closed grooves 30B (i.e., at a portion of the closed grooves 30B closest to the foot-facing surface 20 and the foot 52), and correspondingly increased tensile forces at a base portion 54 of the sole plate, and placing the insert plate 24B in compression by the sole plate 12B. The bending stiffness of the sole assembly 12B thereby increases in the range of flexion FRB at least partially in correlation with such loading.

Figure 19:
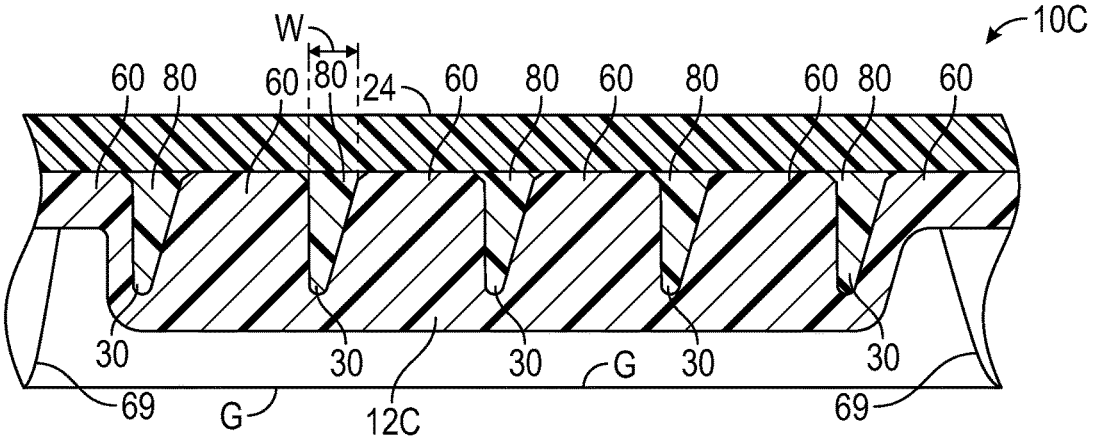
FIG. 19 is a schematic cross-sectional illustration in fragmentary view of an embodiment of a sole assembly having resilient material in the grooves, with the grooves in an open position, in accordance with an aspect of the present teachings.
Figure 20:
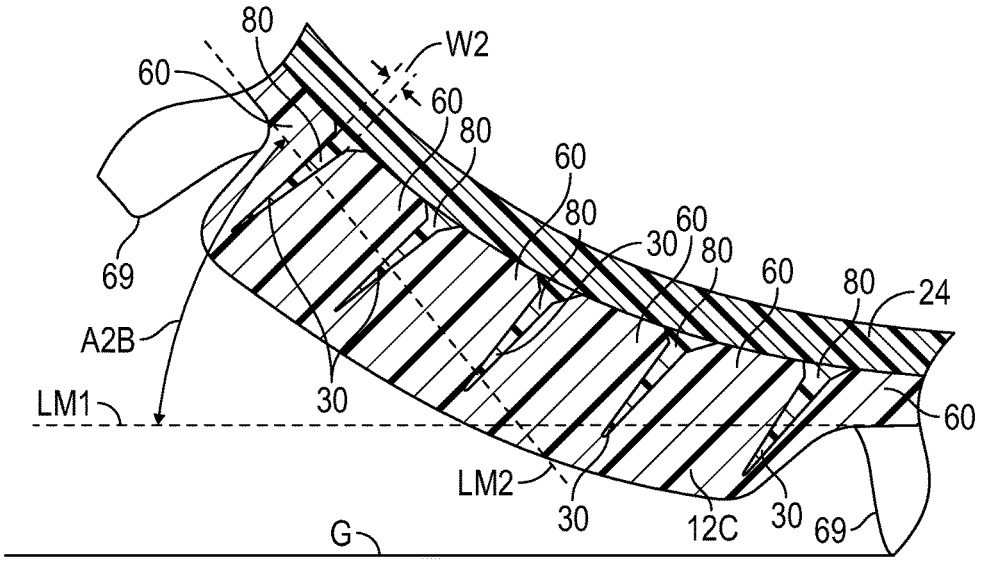
FIG. 20 is a schematic cross-sectional illustration in fragmentary view of the sole assembly of FIG. 19 with the grooves closed.

FIGS. 19 and 20 show a portion of an alternative embodiment of a sole plate 12C that can be used in place of any of the sole plates 12, 12A, and 12B. A resilient material 80 is disposed in the grooves 30. In the embodiment shown, for purposes of illustration, the resilient material 80 is disposed in each of the grooves 30 of the sole plate 12C. Optionally, the resilient material 80 can be disposed in only some of the grooves 30, or in only one of the grooves 30. The resilient material 80 may be a resilient (i.e., reversibly compressible) polymeric foam, such as an ethylene vinyl acetate (EVA) foam or a thermoplastic polyurethane (TPU) foam selected with a compression strength and density that provides a compressive stiffness different than (i.e., less than or greater than) the compressive stiffness of the sole plate 12C. In FIG. 19, the sole assembly 10C is shown in an unflexed position at a flex angle of 0 degrees. The grooves 30 are in the open position in FIG. 19, although they are filled with the resilient material 80. In the embodiment shown, the sole plate 12C is configured to have a greater compressive stiffness (i.e., resistance to deformation in response to compressive forces) than the resilient material 80. Accordingly, when the flex angle increases, the resilient material 80 will begin being compressed by the sole plate 12C during bending of the sole assembly 10C as the sole plate 12C flexes (i.e., bends) until the resilient material 80 reaches a maximum compressed position at a second predetermined flex angle A2B shown in FIG. 20. At the maximum compressed position of the resilient material 80, the grooves 30 are in a closed position. The resilient material 80 increases the bending stiffness of the sole assembly 10C at flex angles less than a flex angle at which the grooves 30 reach the closed position (i.e., the second predetermined flex angle A2B) in comparison to embodiments in which the grooves 30 are empty. The bending stiffness of the sole assembly 10C is therefore at least partially determined by a stiffness of the resilient material 80 at flex angles less than the second predetermined flex angle A2B. In the closed position of the grooves 30 in the sole assembly 10C, adjacent walls in each groove 30 do not contact one another and are not parallel, but are closer to one another than at the open position of the grooves 30. In other words, the closed grooves 30 have a width W2 less than the width W of the open grooves 30.

Figure 21:
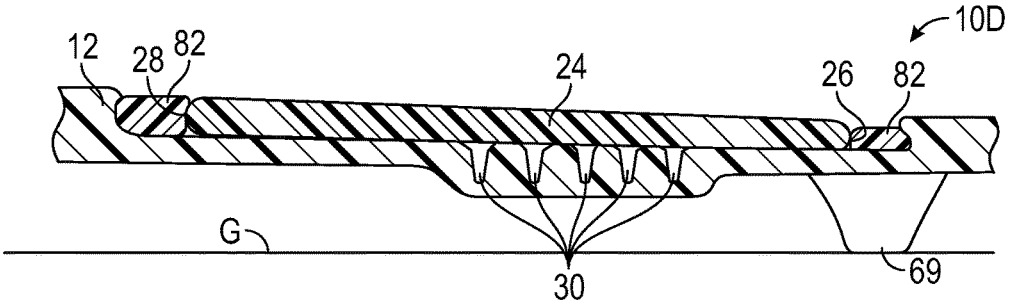
FIG. 21 is a schematic cross-sectional illustration in fragmentary side view of an embodiment of a sole assembly with resilient material in the recess between the insert plate and the sole plate, in accordance with the present teachings.
Figure 22:
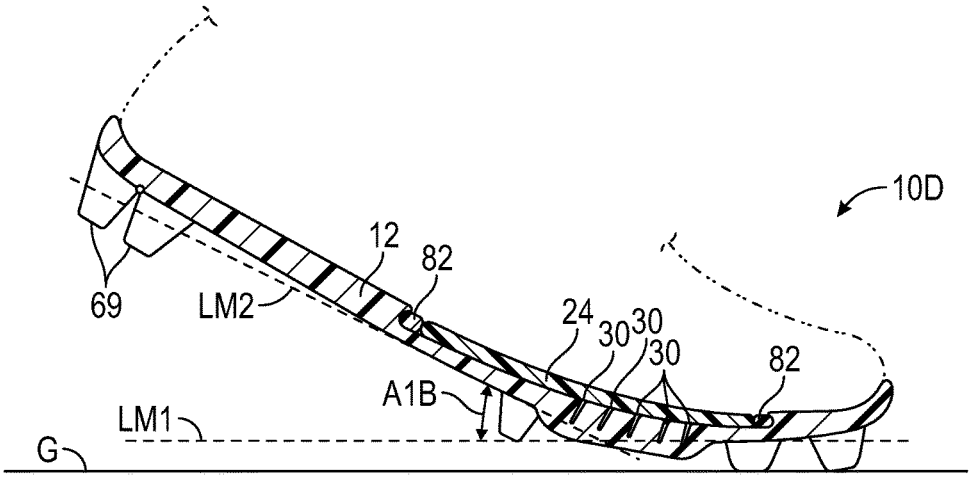
FIG. 22 a schematic cross-sectional illustration in fragmentary side view of the sole assembly of FIG. 21 flexed at a first predetermined flex angle.

FIGS. 21 and 22 show a portion of an alternative embodiment of a sole assembly 10D that can be used in place of any of the sole assemblies 10, 10A, 10B, or 10C. A resilient material 82 is disposed in the recess 22 between the sole plate 12 and at least one of the forward edge 26 of the insert plate 24 and the rearward edge 28 of the insert plate 24. The resilient material 82 has a compressive stiffness different than (i.e., less than or greater than) that of the insert plate 24. In the embodiment shown, the resilient material 82 has a compressive stiffness less than that of the insert plate 24, and is thus compressed during bending of the sole assembly 10 prior to operative engagement of the insert plate 24 with the sole plate 12 during flexing of the sole assembly 10D in the longitudinal direction. In the embodiment shown, for purposes of illustration, the resilient material 82 is disposed in the recess 22 at both the forward edge 26 and the rearward edge 28. For example, the resilient material 82 may be a resilient (i.e., reversibly compressible) polymeric foam, such as an ethylene vinyl acetate (EVA) foam or a thermoplastic polyurethane (TPU) foam selected with a compression strength and density that provides a compressive stiffness less than the compressive stiffness of the insert plate 24. In FIG. 21, the sole assembly 10D is shown in an unflexed position at a flex angle of 0 degrees.

The insert plate 24 is configured to have a greater compressive stiffness than the resilient material 82. Accordingly, when the flex angle increases, the resilient material 82 will begin being compressed between the insert plate 24 and the sole plate 12 as the sole plate 12 flexes until the resilient material 82 reaches a maximum compressed position shown in FIG. 22 at the first predetermined flex angle A1B. The resilient material 82 increases the stiffness of the sole assembly 10D at flex angles less than a flex angle at which the insert plate 24 operatively engages with the sole plate 12 (i.e., a first predetermined flex angle as defined herein) in comparison to embodiments in which the recess 22 is empty between the sole plate 12 and the respective forward and rearward edges 26, 28 of the insert plate 24. The bending stiffness of the sole assembly 10D when flexed in the longitudinal direction is therefore at least partially determined by a compressive stiffness of the resilient material 82 at flex angles less than the first predetermined flex angle.

Because the resilient material 82 is in the maximum compressed position, compressive forces of the sole plate 12 are transferred through the resilient material 82 to the insert plate 24, such that the insert plate 24 is operatively engaged with and under compressive loading by the sole plate 12 when the resilient material 82 is in the maximum compressed position.

Figure 25:
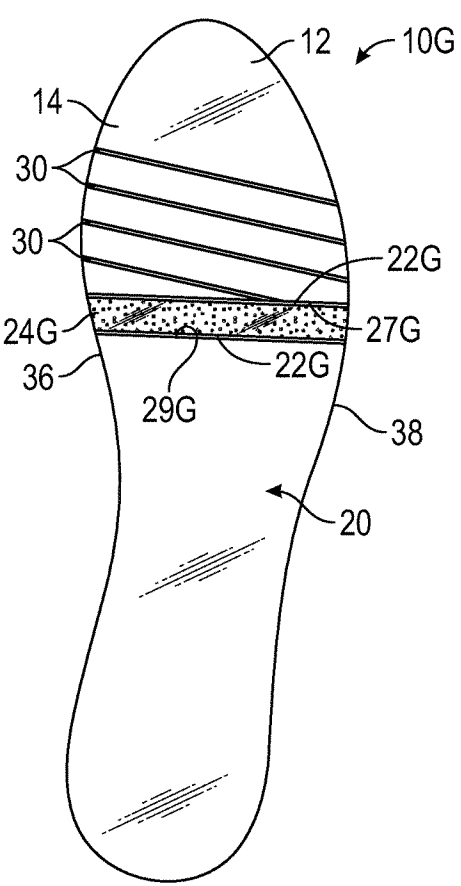
FIG. 25 is a schematic illustration in plan view of another embodiment of a sole assembly for an article of footwear with a sole plate and an insert plate.
Figure 24:
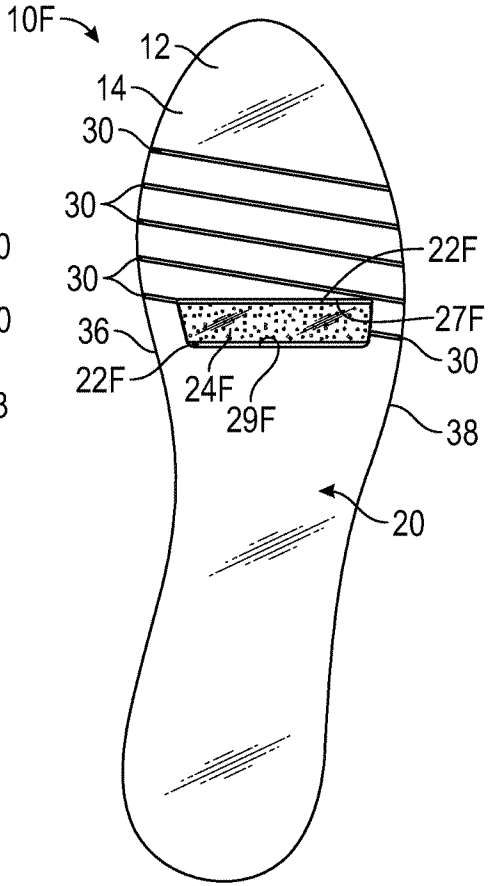
FIG. 24 is a schematic illustration in plan view of another embodiment of a sole assembly for an article of footwear with a sole plate and an insert plate.
Figure 23:
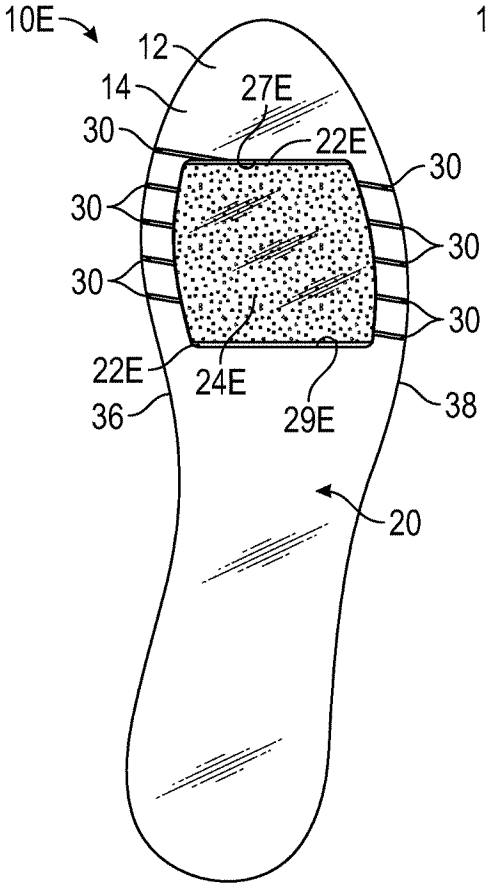
FIG. 23 is a schematic illustration in plan view of another embodiment of a sole assembly for an article of footwear with a sole plate and an insert plate.

FIGS. 23-25 show additional embodiments of sole structures 10E, 10F, and 10G within the scope of the present teachings. Each of the sole structures 10E, 10F, and 10G function as described with respect to sole structure 10, having a change in bending stiffness at a first predetermined flex angle when the insert plate 24E, 24F, or 24G, respectively, operatively engages the sole plate 12, and a second change in bending stiffness at a second predetermined flex angle when the grooves 30 close. The second predetermined flex angle can be less than, equal to, or greater than the first predetermined flex angle.

In sole structure 10E, the sole plate 12 has a recess 22E in the foot-facing surface 20. An insert plate 24E is disposed in the recess 22E. The insert plate 24E has a length in the longitudinal direction of the sole plate 12 that is less than the length of the recess 22E when the sole structure 10E is in the unflexed, relaxed position shown in FIG. 23, as indicated by the small gap visible forward of the insert plate 24E between the front wall 27E of the sole plate 12 and the insert plate 24E, and a small gap visible rearward of the insert plate 24E between the rear wall 29E of the sole plate 12 and the insert plate 24E. Due to this gap, the sole structure 10E bends in dorsiflexion with the insert plate 24E translating relative to the sole plate 12 free from compressive loading by the sole plate 12 during a first range of dorsiflexion, and with a change in bending stiffness when an anterior end of the insert plate 24E engages the front wall 27E and a posterior end of the insert plate 24E engages the rear wall 29E at the first predetermined flex angle. The insert plate 24E flexes under compression by the sole plate 12 when the sole assembly 10E is flexed in the longitudinal direction at flex angles greater than or equal to the first predetermined flex angle. In the embodiment shown, the insert plate 24E is a carbon fiber material, but may be any of the materials discussed herein with respect to the various embodiments of insert plates.

Grooves 30 extend lengthwise generally transversely across the foot-facing surface 20. The grooves 30 may be configured to function as described with respect to grooves of any of the embodiments of sole structures disclosed herein. The longitudinal axis of each groove 30 follows the flex orientation of a foot supported on the foot-facing surface 20. Stated differently, the longitudinal axis of each groove 30 is generally parallel with a line best fit to fall under the MPJ joints of the foot. Both the insert plate 24E and the grooves 30 are generally in the forefoot region 14 of the sole plate 12 where a foot bends the sole plate 12 during dorsiflexion when the sole structure 10E is included in an article of footwear and worn on a foot. The recess 22E and the insert plate 24E are generally longer than the corresponding features of the sole structures 10F and 10G, extending over the entire length of the portion of the sole plate 12 that bends in dorsiflexion. The recess 22E and the sole plate 24E are narrower than the width of the sole plate 12, and the grooves 30 extend laterally outward of the recess 22E between the recess 22E and the medial side 36 and lateral side 38 of the sole plate 12. The grooves 30 are open at flex angles less than a second predetermined flex angle, and closed at flex angles greater than or equal to the second predetermined flex angle. The second predetermined flex angle may be less than, equal to, or greater than the first predetermined flex angle depending on the number and width of the grooves 30. The grooves 30 thus relieve stress in the material of the sole plate 12 that is laterally outward of the recess 22E, as they allow it to bend with less resistance to flexion (i.e., at a lower bending stiffness) when the grooves 30 are open than when they are closed.

In sole structure 10F, the sole plate 12 has a recess 22F in the foot-facing surface 20. An insert plate 24F is disposed in the recess 22F. The insert plate 24F has a length in the longitudinal direction of the sole plate 12 that is less than the length of the recess 22F when the sole structure 10F is in the unflexed, relaxed position shown in FIG. 24, as indicated by the small gap visible forward of the insert plate 24F between the front wall 27F of the sole plate 12 and the insert plate 24F, and a small gap visible rearward of the insert plate 24F between the rear wall 29F of the sole plate 12 and the insert plate 24F. Due to this gap, the sole structure 10F bends in dorsiflexion with the insert plate 24F translating relative to the sole plate 12 free from compressive loading by the sole plate 12 during a first range of dorsiflexion, and with a change in bending stiffness when an anterior end of the insert plate 24F engages the front wall 27F and a posterior end of the insert plate 24F engages the rear wall 29F at the first predetermined flex angle. The insert plate 24F flexes under compression by the sole plate 12 when the sole assembly 10F is flexed in the longitudinal direction at flex angles greater than or equal to the first predetermined flex angle. In the embodiment shown, the insert plate 24F is a carbon fiber material, but may be any of the materials discussed herein with respect to the various embodiments of insert plates.

Grooves 30 extend lengthwise generally transversely across the foot-facing surface 20. The grooves 30 may be configured to function as described with respect to grooves of any of the embodiments of sole structures disclosed herein. The longitudinal axis of each groove 30 follows the flex orientation of a foot supported on the foot-facing surface 20. Stated differently, the longitudinal axis of each groove 30 is generally parallel with a line best fit to fall under the MPJ joints of the foot. The grooves 30 are generally in the forefoot region 14 of the sole plate 12 where a foot bends the sole plate 12 during dorsiflexion when the sole structure 10F is included in an article of footwear and worn on a foot. The recess 22F and the insert plate 24F are generally only toward the rear of the portion that bends in dorsiflexion, and generally fall directly below the MPJ joints of a foot supported on the foot-facing surface 20 of the sole plate 12, but could be anywhere in the portion of the sole plate 12 that bends during dorsiflexion. The recess 22F is narrower than the width of the sole plate 12, and the grooves 30 extend the entire width of the sole plate 12 from the medial side 36 and lateral side 38 of the sole plate 12. The majority of the grooves 30 are entirely forward of the recess 22F. The grooves 30 are open at flex angles less than a second predetermined flex angle, and closed at flex angles greater than or equal to the second predetermined flex angle. The second predetermined flex angle may be less than, equal to, or greater than the first predetermined flex angle depending on the number and width of the grooves 30. A rearmost one of the grooves 30 is interrupted by the recess 22F, and thus relieves stress in the material of the sole plate 12 that is laterally outward of the recess 22F when the sole plate 12 bends. The grooves 30 allow the sole plate 12 to bend with less resistance to flexion (i.e., at a lower bending stiffness) when the grooves 30 are open than when they are closed.

In sole structure 10G, the sole plate 12 has a recess 22G in the foot-facing surface 20. An insert plate 24G is disposed in the recess 22G. The insert plate 24G has a length in the longitudinal direction of the sole plate 12 that is less than the length of the recess 22G when the sole structure 10G is in the unflexed, relaxed position shown in FIG. 25, as indicated by the small gap visible forward of the insert plate 24G between the front wall 27G of the sole plate 12 and the insert plate 24G, and a small gap visible rearward of the insert plate 24G between the rear wall 29G of the sole plate 12 and the insert plate 24G. Due to this gap, the sole structure 10G bends in dorsiflexion with the insert plate 24G translating relative to the sole plate 12 free from compressive loading by the sole plate 12 during a first range of dorsiflexion, and with a change in bending stiffness when an anterior end of the insert plate 24G engages the front wall 27G and a posterior end of the inert plate 24G engages the rear wall 29G at the first predetermined flex angle. The insert plate 24G flexes under compression by the sole plate 12 when the sole assembly 10G is flexed in the longitudinal direction at flex angles greater than or equal to the first predetermined flex angle. In the embodiment shown, the insert plate 24G is a carbon fiber material, but may be any of the materials discussed herein with respect to the various embodiments of insert plates.

Grooves 30 extend lengthwise generally transversely across the foot-facing surface 20. The grooves 30 may be configured to function as described with respect to grooves of any of the embodiments of sole structures disclosed herein. The longitudinal axis of each groove 30 follows the flex orientation of a foot supported on the foot-facing surface 20. Stated differently, the longitudinal axis of each groove 30 is generally parallel with a line best fit to fall under the MPJ joints of the foot. The grooves 30 are generally in the forefoot region 14 of the sole plate 12 where a foot bends the sole plate 12 during dorsiflexion when the sole structure 10G is included in an article of footwear and worn on a foot. The recess 22G and the insert plate 24G are generally only toward the rear of the portion that bends in dorsiflexion, and generally fall directly below the MPJ joints of a foot supported on the foot-facing surface 20 of the sole plate 12, but could be anywhere in the portion of the sole plate 12 that bends during dorsiflexion. The recess 22G extends the entire width of the sole plate 12 from the medial side 36 and lateral side 38 of the sole plate 12. The majority of the grooves 30 are entirely forward of the recess 22G and also extend the entire width of the sole plate 12 from the medial side 36 and lateral side 38 of the sole plate 12. The grooves 30 are open at flex angles less than a second predetermined flex angle, and closed at flex angles greater than or equal to the second predetermined flex angle. The second predetermined flex angle may be less than, equal to, or greater than the first predetermined flex angle depending on the number and width of the grooves 30. The grooves 30 allow the sole plate 12 to bend with less resistance to flexion (i.e., at a lower bending stiffness) when the grooves 30 are open than when they are closed.

In any of the embodiments described herein, the relative bending stiffness and the relative compressive stiffness of the insert plate 24, 24A, 24B, 24E, 24F, or 24G and the respective sole plate 12, 12A, 12B, or 12C can be selected as desired to affect the bending stiffness of the sole assembly 10, 10A, 10B, 10C, 10D, 10E, 10F, or 10G. For example, the material and thickness of the insert plate 24, 24A, 24B, 24E, 24F, or 24G, and the sole plate 12, 12A, 12B, or 12C affect their bending stiffness. Various materials can be used for the insert plate 24, 24A, 24B, 24E, 24F, or 24G, and for the sole plate 12, 12A, 12B, or 12C. For example, a thermoplastic elastomer, such as thermoplastic polyurethane (TPU), a glass composite, a nylon including glass-filled nylons, a spring steel, carbon fiber, ceramic or a dense foam may be used for either of the insert plate 24, 24A, 24B, 24E, 24F, or 24G, and the sole plate 12, 12A, 12B, or 12C.

The sole plate 12, 12A, 12B, or 12C may be configured to have a greater bending stiffness than the insert plate 24, 24A, 24B, 24E, 24F, or 24G, only when the grooves 30, 30A, or 30B are open, only when the grooves 30, 30A, or 30B are closed, or both when the grooves 30, 30A, or 30B are open and when the grooves 30, 30A, or 30B are closed. Alternatively, the insert plate 24, 24A, 24B, 24E, 24F, or 24G may be configured to have a greater bending stiffness than the sole plate 12, 12A, 12B, or 12C both when the grooves 30, 30A, or 30B are open and when the grooves 30, 30A, or 30B are closed.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A sole assembly for an article of footwear comprising:

a sole plate that has a foot-facing surface with a recess disposed in the foot-facing surface;

a single, one-piece insert plate disposed in the recess; wherein an outer perimeter of the insert plate is smaller than the recess; the insert plate having an anterior end, a posterior end, a continuous expanse between the anterior end and the posterior end, and a length extending between the anterior end and the posterior end that is less than a length of the recess; and wherein the insert plate is not fixed to the sole plate such that the insert plate flexes free of compressive loading by the sole plate when a forefoot portion of the sole assembly is dorsiflexed in a first portion of a flexion range, and operatively engages with the sole plate at the anterior end and the posterior end and is compressed by the sole plate when the forefoot portion of the sole assembly is dorsiflexed in a second portion of the flexion range that includes flex angles greater than in the first portion of the flexion range.

2. The sole assembly of claim 1, wherein:

the first portion of the flexion range includes flex angles of the sole assembly less than a first predetermined flex angle, and the second portion of the flexion range includes flex angles of the sole assembly greater than or equal to the first predetermined flex angle; and the sole assembly has a change in bending stiffness at the first predetermined flex angle.

3. The sole assembly of claim 2, wherein the anterior and posterior ends of the insert plate are compressed by the sole plate at the first predetermined flex angle such that the insert plate flexes under compression by the sole plate when the sole assembly is dorsiflexed at flex angles greater than or equal to the first predetermined flex angle.

4. The sole assembly of claim 1, wherein the insert plate operatively engages with the sole plate only at the outer perimeter of the insert plate.

5. The sole assembly of claim 1, wherein:

the insert plate has a front edge extending from a medial side of the insert plate to a lateral side of the insert plate and a rear edge extending from the medial side of the insert plate to the lateral side of the insert plate;

the sole plate has a front wall at a forward perimeter of the recess, and a rear wall at a rearward perimeter of the recess;

the front edge is spaced apart from the front wall, or the rear edge is spaced apart from the rear wall, or both the front edge is spaced apart from the front wall and the rear edge is spaced apart from the rear wall; and the front edge is configured to operatively engage with the front wall, and the rear edge is configured to operatively engage with the rear wall to distribute compressive loading of the insert plate by the sole plate over the front edge and the rear edge of the insert plate.

6. The sole assembly of claim 5, wherein at least one of the front edge and the rear edge is rounded between the medial side and the lateral side.

7. The sole assembly of claim 1, wherein:

the sole plate has a lip at the recess; and the length of the recess is below the lip and is greater than a length of the recess at the lip, both the anterior end and the posterior end of the insert plate engaging the sole plate below the lip.

8. The sole assembly of claim 1, further comprising:

at least one groove extending transversely in the foot-facing surface of the sole plate;

wherein the first portion of the flexion range includes flex angles of the sole assembly less than a first predetermined flex angle, and the second portion of the flexion range includes flex angles of the sole assembly greater than or equal to the first predetermined flex angle;

wherein the sole assembly has a change in bending stiffness at the first predetermined flex angle; and wherein the at least one groove is configured to be open when the sole assembly is dorsiflexed at flex angles less than a second predetermined flex angle, and to be closed when the sole assembly is dorsiflexed at flex angles greater than or equal to the second predetermined flex angle, the sole plate having a resistance to deformation in response to compressive forces applied across the at least one groove when the at least one groove is closed so that the sole assembly has an additional change in bending stiffness at the second predetermined flex angle.

9. The sole assembly of claim 8, wherein:

the at least one groove has at least a predetermined depth and width; and the length of the insert plate and the depth and width of the at least one groove is such that the insert plate operatively engages with the sole plate prior to the at least one groove closing, the second predetermined flex angle thereby being greater than the first predetermined flex angle.

10. The sole assembly of claim 8, wherein:

the at least one groove has at least a predetermined depth and width; and the length of the insert plate and the depth and width of the at least one groove is such that the at least one groove closes prior to the insert plate operatively engaging with the sole plate, the second predetermined flex angle thereby being less than first predetermined flex angle.

11. The sole assembly of claim 8, wherein:

the at least one groove has at least a predetermined depth and width; and the length of the insert plate and the depth and width of the at least one groove is such that the insert plate operatively engages with the sole plate when the at least one groove closes, the second predetermined flex angle thereby being the same as the first predetermined flex angle.

12. The sole assembly of claim 8, wherein:

the at least one groove has at least a predetermined depth and width selected so that adjacent walls of the sole plate at the at least one groove are nonparallel when the at least one groove is open.

13. The sole assembly of claim 12, wherein a forward one of the adjacent walls at the at least one groove inclines forward more than a rearward one of the adjacent walls at the at least one groove when the at least one groove is open.

14. The sole assembly of claim 8, wherein the at least one groove extends transversely beyond the recess.

15. The sole assembly of claim 8, wherein the sole plate includes:

a first slot extending longitudinally relative to the sole plate and through the sole plate between a medial side of the sole plate and the at least one groove; and a second slot extending longitudinally relative to the sole plate and through the sole plate between a lateral side of the sole plate and the at least one groove.

16. The sole assembly of claim 8, wherein:

the sole plate includes a first notch in a medial side of the sole plate and a second notch in a lateral side of the sole plate; and the first notch and the second notch are aligned with the at least one groove.

17. A sole assembly for an article of footwear comprising:

a sole plate having a recess in a foot-facing surface and having a lip above a front wall of the recess and above a rear wall of the recess;

an insert plate supported by the sole plate in the recess; wherein:

a portion of the sole plate below the recess extends continuously from a portion of the sole plate forward of the recess to a portion of the sole plate rearward of the recess;

the insert plate is not fixed to the sole plate and is configured to translate in the recess relative to the sole plate when the sole assembly is flexed in a longitudinal direction of the sole assembly over a first range of flexion such that the insert plate is free from compressive loading by the sole plate during the first range of flexion; and an anterior end of the insert plate engaging the front wall below the lip and a posterior end of the insert plate engaging the rear wall below the lip when the sole plate is flexed in the longitudinal direction at a first predetermined flex angle thereby placing the insert plate under compression by the sole plate in a second range of flexion greater than the first range of flexion, the sole assembly thereby having a change in bending stiffness at the first predetermined flex angle.

18. The sole assembly of claim 17, wherein:

the sole plate has at least one transversely-extending groove in the foot-facing surface at the recess;

the at least one transversely-extending groove is open during the first range of flexion; and the at least one transversely-extending groove is closed when the sole assembly is flexed in the longitudinal direction over a third range of flexion greater than the second range of flexion, the sole assembly thereby having a different bending stiffness in the third range of flexion than in the second range of flexion.

19. The sole assembly of claim 1, wherein:

the sole plate has a medial side and a lateral side; and the recess extends only partway across the sole plate between the lateral side and the medial side.

20. The sole assembly of claim 19, wherein the recess extends only partway through a depth of the sole plate, the sole plate surrounding a medial side, a lateral side, a front wall, a rear wall, and a bottom of the recess and extending continuously from the front wall to the rear wall under the recess.

* * * * *